US011338179B2

(12) United States Patent
Takechi

(10) Patent No.: US 11,338,179 B2
(45) Date of Patent: May 24, 2022

(54) GOLF CLUB HEAD

(71) Applicant: BRIDGESTONE SPORTS CO., LTD., Tokyo (JP)

(72) Inventor: Takaharu Takechi, Tokyo (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 0 days.

(21) Appl. No.: 17/348,983

(22) Filed: Jun. 16, 2021

(65) Prior Publication Data

US 2022/0016496 A1 Jan. 20, 2022

(30) Foreign Application Priority Data

Jul. 15, 2020 (JP) ..... JP2020-121408
Jul. 15, 2020 (JP) ..... JP2020-121411

(51) Int. Cl.
*A63B 53/04* (2015.01)

(52) U.S. Cl.
CPC ..... *A63B 53/0433* (2020.08); *A63B 53/0437* (2020.08); *A63B 53/0466* (2013.01)

(58) Field of Classification Search
CPC ..... A63B 53/0433; A63B 53/0437; A63B 53/0466; A63B 53/045; A63B 53/0454
USPC ..... 473/324–350, 287–292
See application file for complete search history.

(56) References Cited

U.S. PATENT DOCUMENTS 5,080,366 A * 1/1992 Okumoto ..... A63B 60/00 473/348
5,180,166 A * 1/1993 Schmidt ..... A63B 53/04 473/332
5,419,559 A * 5/1995 Melanson ..... A63B 53/04 473/346
6,010,411 A * 1/2000 Reyes ..... A63B 60/00 473/345
6,354,962 B1 3/2002 Galloway et al.
6,595,871 B2 * 7/2003 Sano ..... A63B 53/04 473/342
6,645,087 B2 * 11/2003 Yabu ..... A63B 53/0466 473/342
6,783,465 B2 * 8/2004 Matsunaga ..... A63B 60/52 473/329

(Continued)

FOREIGN PATENT DOCUMENTS

JP 2005-168565 6/2005
JP 2005-253606 9/2005

(Continued)

*Primary Examiner* — Sebastiano Passaniti
(74) *Attorney, Agent, or Firm* — IPUSA, PLLC

(57) ABSTRACT

A golf club head having a hollow structure is provided. The golf club head includes a face, and a body including at least a crown, a sole, and a hosel chamber. The crown, the sole, and the hosel chamber include laminated layers of a fiber-reinforced resin. The crown includes at least one first rigidity control portion that partially extends in a toe-heel direction. The sole includes at least one second rigidity control portion that extends from a back surface side of the face toward a back end of the body. One of the first rigidity control portion and the second rigidity control portion decreases flexural rigidity in a face-back direction, and the other of the first rigidity control portion and the second rigidity control portion increases flexural rigidity in the face-back direction.

17 Claims, 22 Drawing Sheets

(56) References Cited

U.S. PATENT DOCUMENTS 6,852,038 B2 * 2/2005 Yabu ..... A63B 60/00 473/224
6,932,719 B2 * 8/2005 Yabu ..... A63B 53/0466 473/345
7,261,645 B2 * 8/2007 Oyama ..... A63B 60/00 473/345
7,294,064 B2 * 11/2007 Tsurumaki ..... A63B 53/0466 473/329
7,390,271 B2 * 6/2008 Yamamoto ..... A63B 53/0466 473/345
7,396,298 B2 * 7/2008 Jertson ..... A63B 53/0466 473/346
7,402,113 B2 * 7/2008 Mori ..... A63B 53/0466 473/348
7,758,453 B2 * 7/2010 Horacek ..... A63B 53/0466 473/345
7,806,781 B2 * 10/2010 Imamoto ..... A63B 53/0466 473/332
7,887,433 B2 * 2/2011 Hoffman ..... A63B 53/0466 473/327
7,905,799 B2 * 3/2011 Kouno ..... A63B 53/0466 473/345
8,172,697 B2 * 5/2012 Cackett ..... A63B 60/52 473/329
8,414,421 B2 * 4/2013 Jertson ..... A63B 53/0466 473/332
8,608,585 B2 * 12/2013 Stites ..... A63B 60/00 473/282
8,651,975 B2 * 2/2014 Soracco ..... A63B 60/00 473/332
9,393,465 B2 * 7/2016 Stokke ..... A63B 53/0466
9,457,245 B2 10/2016 Lee
9,901,793 B2 * 2/2018 Ban ..... A63B 53/0466
10,702,750 B1 * 7/2020 Wada ..... A63B 53/0466
10,716,974 B2 * 7/2020 Mizutani ..... A63B 60/002
11,135,484 B2 * 10/2021 Kitagawa ..... A63B 53/0466
2002/0108735 A1 * 8/2002 Kuo ..... A63B 53/0466 164/107
2004/0121853 A1 * 6/2004 Caldwell ..... A63B 60/00 473/345
2005/0119070 A1 * 6/2005 Kumamoto ..... A63B 53/0466 473/345
2005/0209022 A1 9/2005 Yamamoto
2005/0245328 A1 11/2005 Kouno et al.
2007/0207877 A1 9/2007 Nishio
2008/0045356 A1 * 2/2008 Lin ..... A63B 53/0466 473/346
2008/0081709 A1 4/2008 Hirano
2010/0048324 A1 * 2/2010 Wada ..... A63B 53/0466 473/346
2011/0034262 A1 * 2/2011 Takechi ..... A63B 53/0466 473/242
2011/0207552 A1 8/2011 Finn et al.
2015/0360099 A1 12/2015 Ban et al.
2019/0247724 A1 * 8/2019 Shimahara ..... A63B 60/52

FOREIGN PATENT DOCUMENTS

JP 2005-296043 10/2005
JP 2005-296626 10/2005
JP 2005-312646 11/2005
JP 2006-320529 11/2006
JP 2006-341136 12/2006
JP 2007-229391 9/2007
JP 2008-104864 5/2008
JP 2013-520229 6/2013
JP 2016-002136 1/2016

* cited by examiner

GOLF CLUB HEAD

CROSS-REFERENCE TO RELATED APPLICATIONS

This application is based on and claims priority to Japanese Patent Application No. 2020-121408, filed on Jul. 15, 2020, and Japanese Patent Application No. 2020-121411, filed on Jul. 15, 2020, the entire contents of which are incorporated herein by reference.

BACKGROUND OF THE INVENTION

1. Field of the Invention

The disclosures herein relate to a golf club head.

2. Description of the Related Art

Conventionally, wood-type golf club heads including crowns, faces, and soles are known. Such a golf club head may be formed solely of a metallic material such as titanium. A wood-type golf club head that is formed of a metallic material and a fiber-reinforced resin (namely partially formed of a fiber-reinforced resin) has also been proposed.

A golf club head that is at least partially formed of a fiber-reinforced resin can be reduced in weight, increased in volume, and so on as compared to a golf club head formed solely of a metallic material. Therefore, the golf club head at least partially formed of a fiber-reinforced resin can provide a greater degree of freedom in design in many ways than a golf club head formed solely of a metallic material.

RELATED-ART DOCUMENTS

Patent Documents

Patent Document 1: Japanese Patent No. 4741388
Patent Document 2: Japanese Patent No. 4212616
Patent Document 3: Japanese Laid-open Patent Publication No. 2005-296043
Patent Document 4: Japanese Laid-open Patent Publication No. 2005-168565
Patent Document 5: Japanese Patent No. 4664733
Patent Document 6: Japanese Laid-open Patent Publication No. 2005-253606
Patent Document 7: Japanese Patent No. 4403084
Patent Document 8: Japanese Patent No. 4388411
Patent Document 9: Japanese Patent No. 5161518
Patent Document 10: Japanese Laid-open Patent Publication No. 2016-002136
Patent Document 11: Japanese Patent No. 5762442
Patent Document 12: U.S. Pat. No. 9,457,245

SUMMARY OF THE INVENTION

According to an aspect of the present disclosure, a golf club head having a hollow structure is provided. The golf club head includes a face, and a body including at least a crown, a sole, and a hosel chamber. The crown, the sole, and the hosel chamber include laminated layers of a fiber-reinforced resin. The crown includes at least one first rigidity control portion that partially extends in a toe-heel direction. The sole includes at least one second rigidity control portion that extends from a back surface side of the face toward a back end of the body. One of the first rigidity control portion and the second rigidity control portion decreases flexural rigidity in a face-back direction, and the other of the first rigidity control portion and the second rigidity control portion increases flexural rigidity in the face-back direction.

According to an aspect of the present disclosure, a golf club head having a hollow structure is provided. The golf club head includes a face, and a body including at least a crown, a sole, and a hosel chamber. The crown, the sole, and the hosel chamber include laminated layers of a fiber-reinforced resin. The body includes a plurality of rigidity control portions that extend from a back surface side of the face toward a back end of the body. The plurality of rigidity control portions are a plurality of ribs formed of a fiber-reinforced resin. Each of the ribs has a width greater than or equal to 0.5 mm and less than or equal to 3.0 mm, and a height greater than or equal to 0.5 mm and less than or equal to 10 mm.

According to an aspect of the present disclosure, a golf club head having a hollow structure is provided. The golf club head includes a face, and a body including a crown and a sole. At least the sole includes laminated layers of a fiber-reinforced resin. The sole includes a recessed portion that is recessed from an outer surface side toward an inner surface side of the sole. The recessed portion includes a connector made of metal. A rod is attached to the connector such that the rod extends from the recessed portion to a back surface of the face and contacts the back surface of the face.

BRIEF DESCRIPTION OF THE DRAWINGS

Other objects and further features of the present invention will be apparent from the following detailed description when read in conjunction with the accompanying drawings, in which.

DESCRIPTION OF THE EMBODIMENTS

Figure 1:
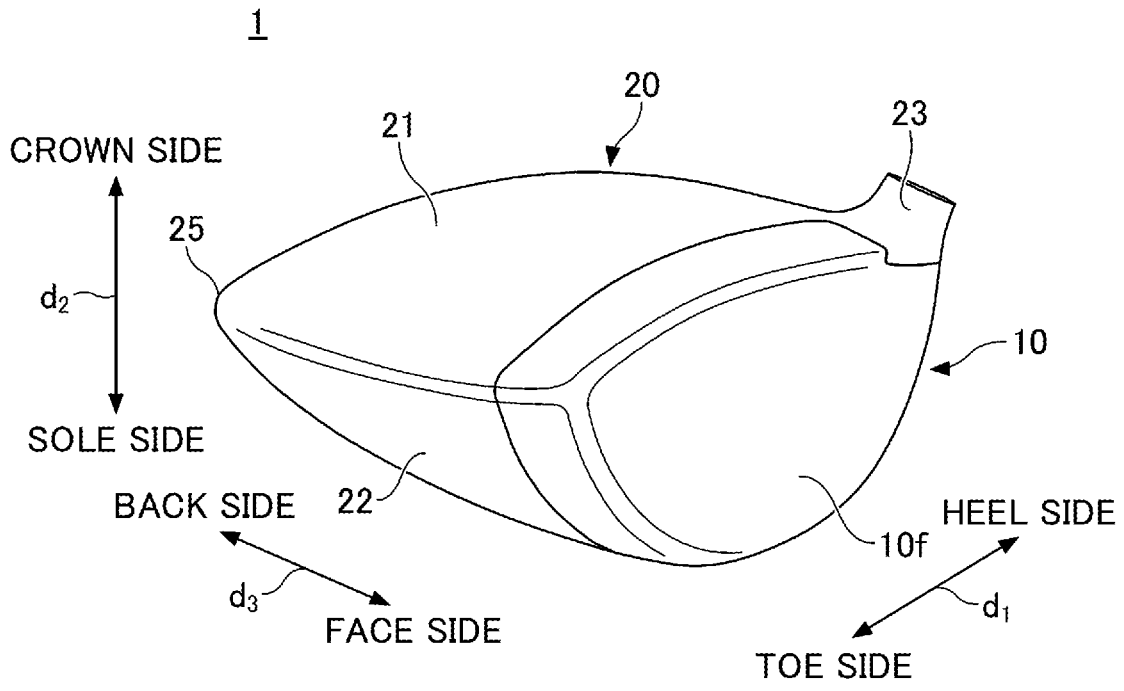
FIG. 1 is a perspective view of a golf club head 1 according to a first embodiment.

Various golf club heads at least partially formed of fiber-reinforced resins have been discussed. However, in such conventional golf club heads at least partially formed of fiber-reinforced resins, rigidity is not sufficiently controlled.

According to an aspect of the present disclosure, it is possible to provide a golf club head having improved in ball striking performance by controlling the rigidity of a crown and the rigidity of a sole that are formed of a fiber-reinforced resin.

According to another aspect of the present disclosure, it is possible to provide a golf club head that is at least partially formed of a fiber-reinforced resin and that exhibits improved ball striking performance.

In the following, embodiments of the present invention will be described with reference to the accompanying drawings. In the drawings, the same elements are denoted by the same reference numerals and a duplicate description thereof may be omitted.

First Embodiment

FIG. 1 is a perspective view of a golf club head 1 according to a first embodiment. FIG. is an exploded perspective view of the golf club head 1 according to the first embodiment. In FIG. 1, the double-headed arrow $d_1$ indicates the "toe-heel" (left-right) direction, namely, the direction from the toe side to the heel side or the direction from the heel side to the toe side, of the golf club head 1, the double-headed arrow $d_2$ indicates the "crown-sole" (up-down) direction, namely, the direction from the crown side to the sole side or the direction from the sole side to the crown side, of the golf club head 1, and the double-headed arrow $d_3$ indicates the "face-back" (front-rear) direction, namely, the direction from the face side to the back side or the direction from the back side to the face side, of the golf club head 1.

Figure 2:
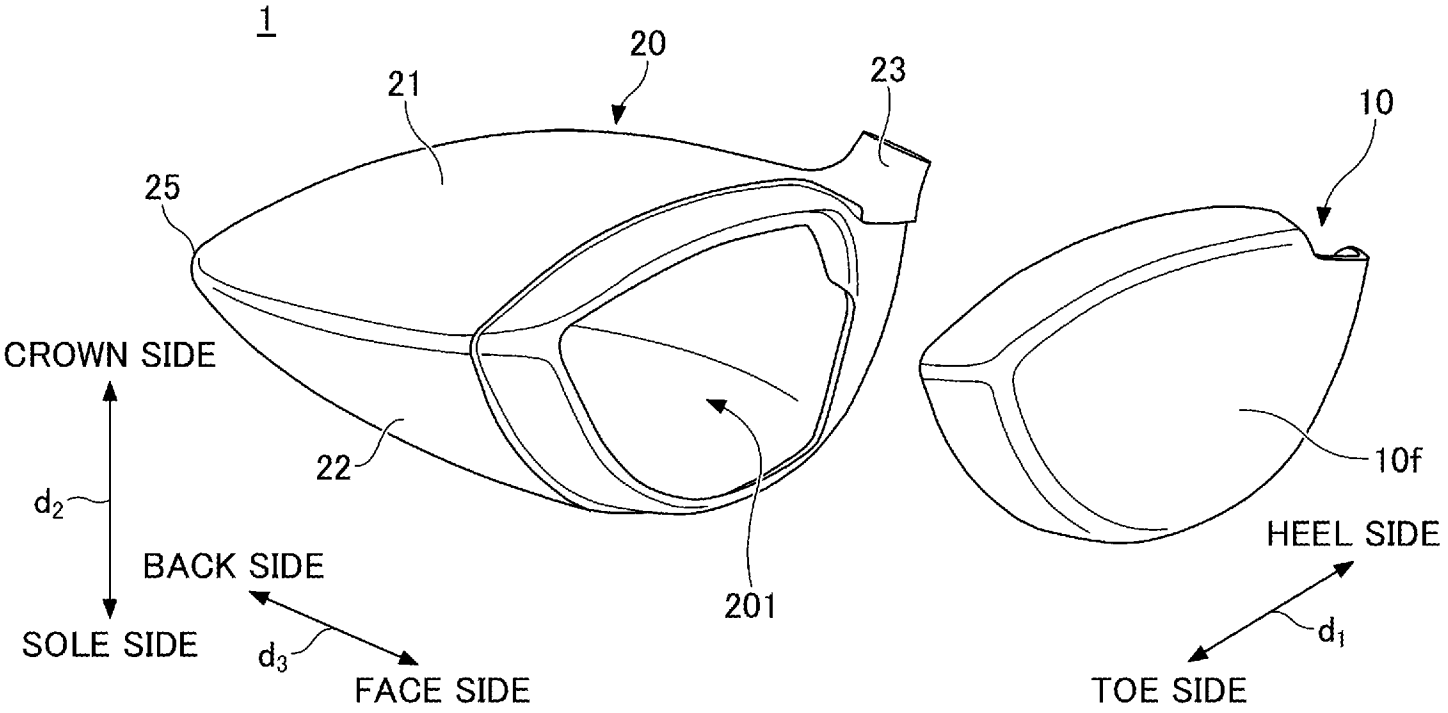
FIG. 2 is an exploded perspective view of the golf club head 1 according to the first embodiment.

The golf club head 1 depicted in FIG. 1 and FIG. 2 is a wood-type golf club head such as a driver club head, but may be a hybrid club head or fairway wood club head. The golf club head 1 includes a face 10 and a body 20, and has a hollow structure in which the face 10 is joined to and integrated with the body 20.

The body 20 has an opening 201 on the face side of the golf club head 1. A step, on which the face 10 is positioned, is formed on the outer periphery of the opening 201 of the body 20. The face 10 is fitted to the step and joined to the body 20 so as to close the opening 201. Note that the surface inside the hollow structure may be referred to as an inner surface, and the surface outside the hollow structure may be referred to as an outer surface.

The face 10 has a face surface 10*f*, which serves as a ball-striking surface. The face 10 has a predetermined thickness, and the face surface 10*f* forms the outer surface of the face 10. The face 10 may be formed of titanium, a titanium alloy, stainless steel, aluminum, an aluminum alloy, a ferrous metal, magnesium, a magnesium alloy, or the like.

The face 10 may be formed of a fiber-reinforced resin. The fiber-reinforced resin is a composite material of a resin and fibers to serve as a reinforcing member. Examples of the fibers constituting the fiber-reinforced resin include carbon fibers, glass fibers, aramid fibers, polyethylene fibers, Zyron®, and boron fibers. Examples of the resin constituting the fiber-reinforced resin include epoxy resins, phenolic resins, polyester resins, and polycarbonate resins. For example, the face 10 can be formed of a carbon fiber-reinforced resin.

The body 20 includes a crown 21, a sole 22, and a hosel chamber 23. The crown 21 defines a top portion of the golf club head 1. The sole 22 defines a bottom portion of the golf club head 1. The hosel chamber 23 houses a hosel to which a shaft is coupled. A back end 25 of the body 20 is located on the opposite side from the face 10, and is a portion by which the crown 21 and the sole 22 are connected.

In the body 20, at least the crown 21, the sole 22, and the hosel chamber 23 may be formed by laminating layers of a fiber-reinforced resin. The crown 21, the sole 22, and the hosel chamber 23 may be integrally formed by laminating layers of a fiber-reinforced resin. For example, the crown 21, the sole 22, and the hosel chamber 23 can be formed by laminating layers of a carbon fiber-reinforced resin. Note that if the face 10 is formed of a fiber-reinforced resin, the crown 21, the sole 22, and the hosel chamber 23 may be formed of the same fiber-reinforced resin as the face 10.

Figure 3:
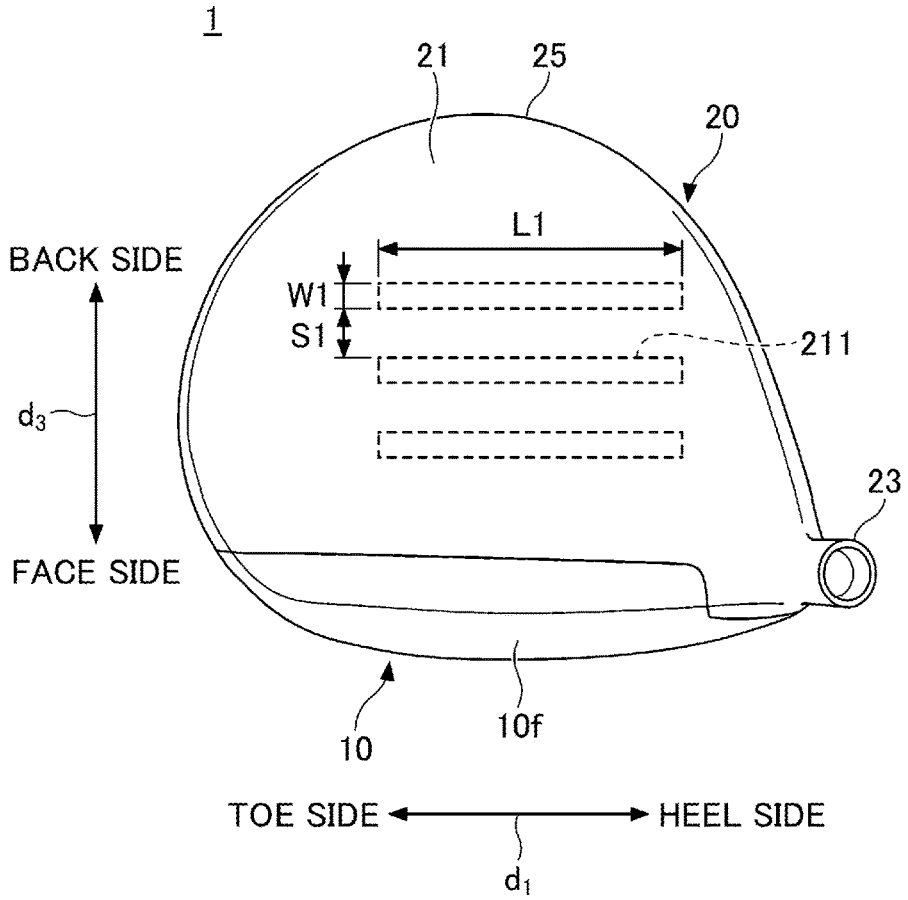
FIG. 3 is a plan view of the golf club head 1 according to the first embodiment.
Figure 4:
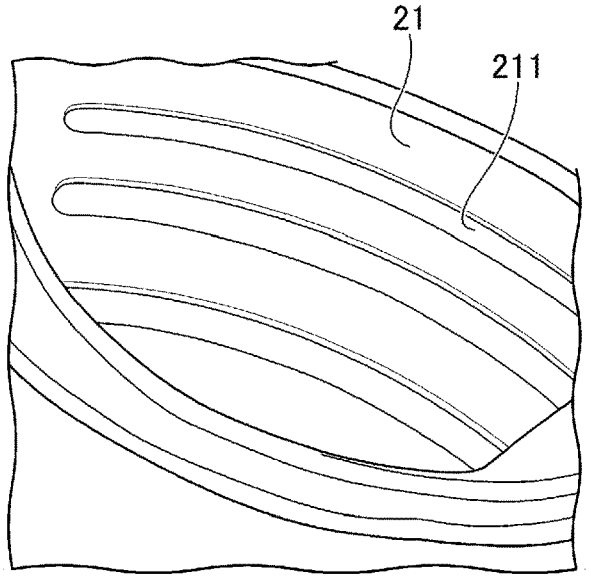
FIG. 4 is a partially enlarged view of the golf club head 1 when viewed from the inner surface of a crown 21.

FIG. 3 is a plan view of the golf club head 1 according to the first embodiment. FIG. 4 is a partially enlarged view of the golf club head 1 when viewed from the inner surface of the crown 21. As illustrated in FIG. 3 and FIG. 4, the crown 21 includes three thin slits 211.

The slits 211 may be recessed portions that are elongated to partially extend in the toe-heel direction and are recessed from the inner surface of the crown 21 toward the outer surface of the crown 21. The slits 211 may be arranged at predetermined intervals. The slits 211 serve as rigidity control portions that decrease the flexural rigidity mainly in the face-back direction while reducing the influence on the flexural rigidity in the toe-heel direction.

Each of the slits 211 has a width W1, for example, greater than or equal to 1.0 mm and less than or equal to 10.0 mm and preferably greater than or equal to 2.0 mm and less than or equal to 5.0 mm. The distance S1 between two adjacent slits 211 may be, for example, greater than or equal to 1.0 mm and less than or equal to 20.0 mm and preferably greater than or equal to 3.0 mm and less than or equal to 8.0 mm. Each of the slits 211 may have a depth, for example, greater than or equal to 0.1 mm and less than or equal to 1.0 mm and preferably greater than or equal to 0.2 mm and less than or equal to 0.4 mm. Each of the slits 211 may have a length L1, for example, greater than or equal to 10.0 mm and less than or equal to 120.0 mm and preferably greater than or equal to 40.0 mm and less than or equal to 80.0 mm.

In FIG. 3, the three slits 211 are provided; however, this is merely an example. At least one slit 211 may be provided, and preferably, a plurality of slits 211 may be provided. Any number of slits can be provided depending on the required rigidity. As the number of slits 211 increases, the rigidity of the crown 21 decreases as long as the slits 211 have the same width, length, and depth.

Figure 5:
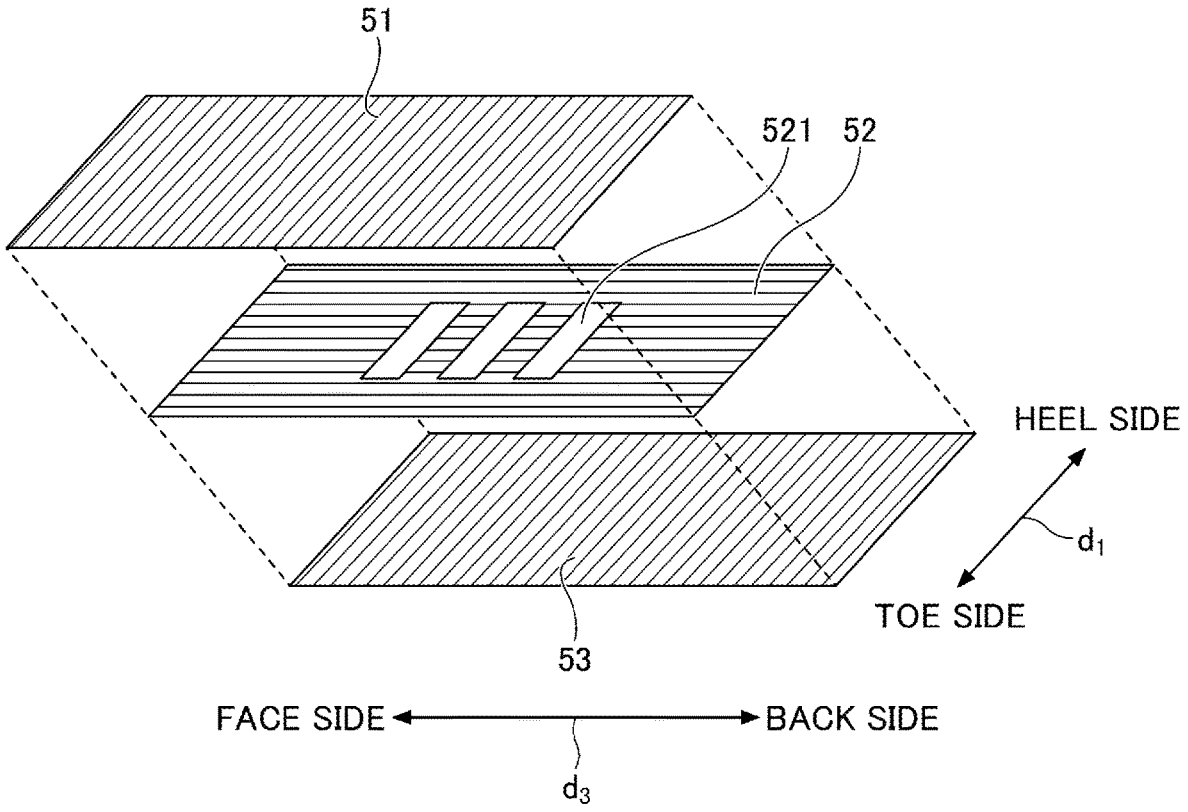
FIG. 5 is a diagram illustrating a specific configuration of rigidity control portions of the crown 21.

The crown 21 may be formed by laminating three layers of prepregs as illustrated in FIG. 5 while heating and applying pressure to the prepregs. However, the crown 21 may be formed by laminating more than three layers of prepregs.

In FIG. 5, unidirectional (UD) prepregs in which reinforcing fibers are unidirectionally oriented and impregnated with a resin may be used as prepregs 51 and 53, which are located at the top and the bottom of the crown 21. The fibers in the prepregs 51 and 53 may be oriented approximately in the toe-heel direction. However, UD prepregs in which fibers are oriented to be inclined with respect to the toe-heel direction, or prepregs in which reinforcing fibers are woven vertically and horizontally and impregnated with a resin may also be used as the prepregs 51 and 53.

As the prepreg 52 sandwiched between the prepregs 51 and 53, a UD prepreg in which reinforcing fibers are unidirectionally oriented and impregnated with a resin may be used. The fibers in the prepreg 52 are oriented approximately in the face-back direction. The prepreg 52 is provided with three slits 521. When the prepregs 51 through 53 are processed, the slits 521 function as the slits 211.

As described above, the UD prepreg in which the fibers are oriented approximately in the face-back direction is used as the prepreg 52, and the slits 521 elongated to extend in the toe-heel direction are formed in the prepreg 52. With this configuration, the flexural rigidity mainly in the face-back direction can be decreased while reducing the influence on the flexural rigidity in the toe-heel direction.

Figure 6:
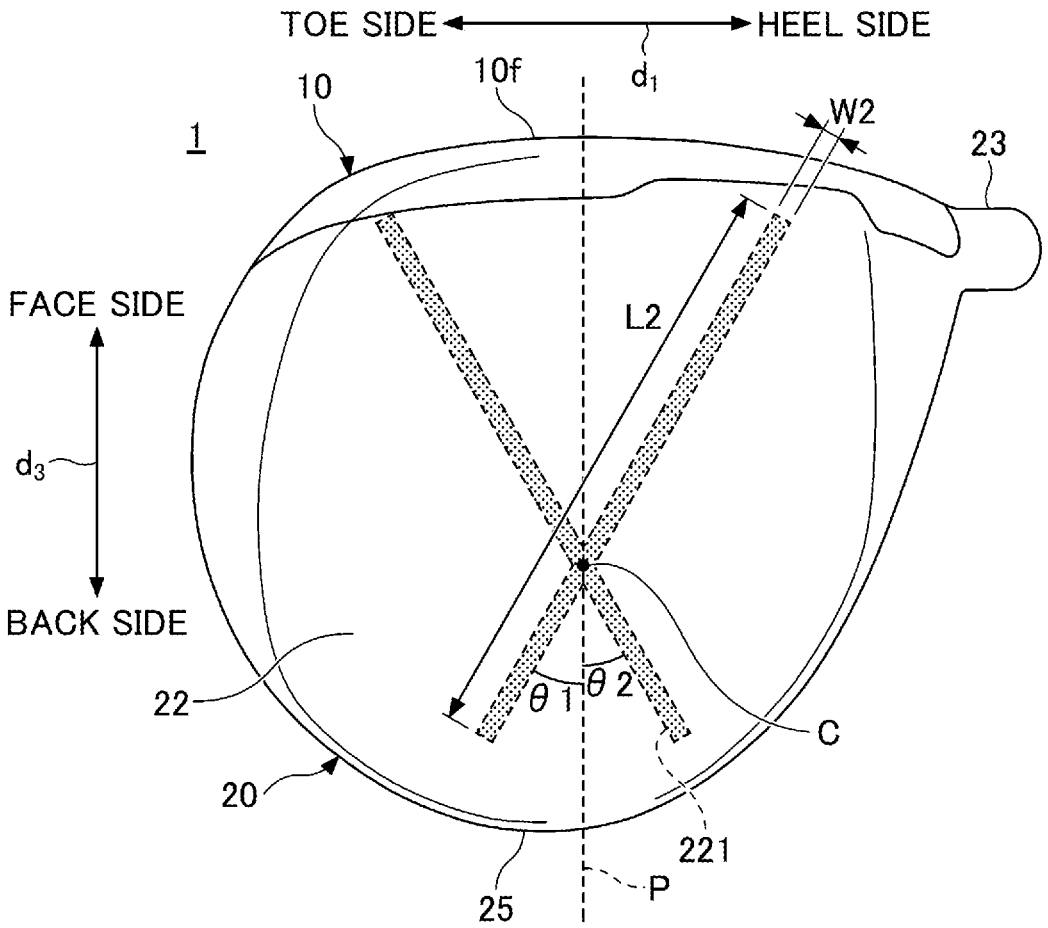
FIG. 6 is a bottom view of the golf club head 1 according to the first embodiment.
Figure 7:
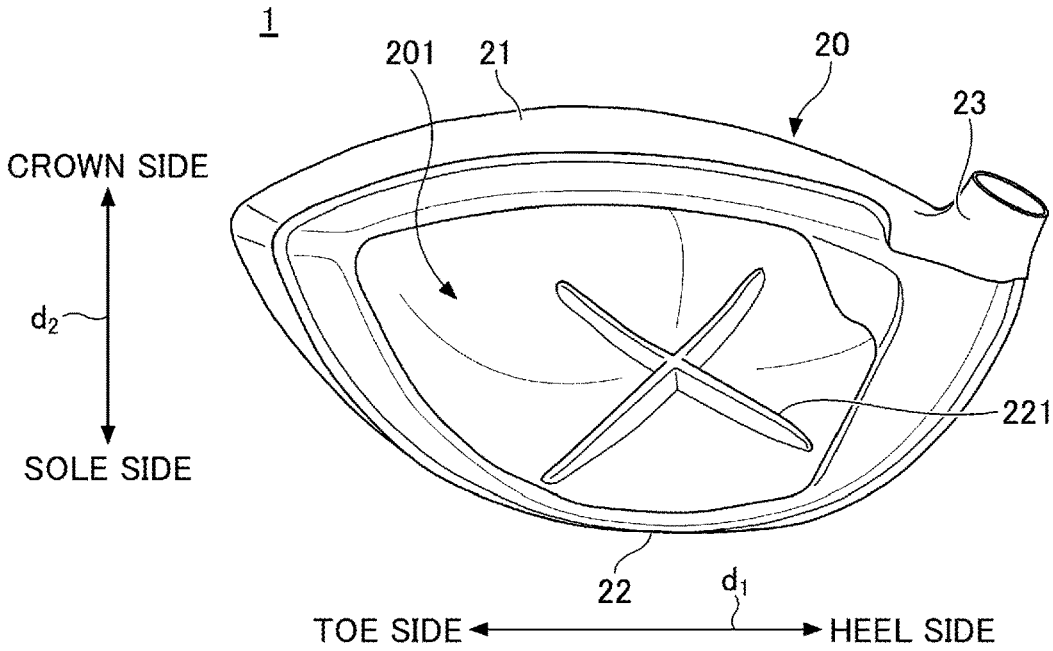
FIG. 7 is a front view of a body of the golf club head 1 according to the first embodiment.

FIG. 6 is a bottom view of the golf club head 1 according to the first embodiment. FIG. 7 is a front view of the body of the golf club head 1 according to the first embodiment. As illustrated in FIG. 6 and FIG. 7, the sole 22 includes two ribs 221. The two ribs 221 may be formed of a fiber-reinforced resin and arranged to intersect with each other when viewed in the crown-sole direction. The ribs 221 may be formed of the same fiber-reinforced resin as the sole 22. The ribs 221 serve as rigidity control portions that increase the flexural rigidity in the face-back direction. Carbon fibers of the fiber-reinforced resin constituting the sole 22 are preferably oriented in directions approximately the same as the extending directions of the ribs 221.

The two ribs 221 are projecting portions that are elongated to extend from the back surface side of the face 10 toward the back end 25 and inclined with respect to a plane P. The plane P is perpendicular to a horizontal ground plane on which the golf club head 1 rests at a predetermined lie angle and a predetermined loft angle, and includes an axis that extends from the center of the face 10 in a direction normal to the face 10. Viewing in the crown-sole direction means viewing in a direction normal to the horizontal ground plane on which the golf club head 1 rests at the predetermined lie angle and the predetermined loft angle.

When viewed in the crown-sole direction, inclination angles θ1 and θ2 of the two ribs 221 with respect to the plane P may be, for example, greater than or equal to 15 degrees and less than or equal to 45 degrees, and are preferably greater than or equal to 25 degrees and less than or equal to 35 degrees.

When viewed in the crown-sole direction, an intersection C of the two ribs 221 is preferably positioned so as to overlap with the plane P. By positioning the two ribs 221 in this manner, the rigidity of a part of the sole 22 can be readily increased.

Each of the ribs 221 has a width W2, for example, greater than or equal to 0.5 mm and less than or equal to 3.0 mm and preferably greater than or equal to 1.0 mm and less than or equal to 2.0 mm. Each of the ribs 221 has a height greater than or equal to 0.5 mm and less than or equal to 10 mm and preferably greater than or equal to 2.0 mm and less than or equal to 6.0 mm. Each of the ribs 221 has a length L2, for example, greater than or equal to 30.0 mm and less than or equal to 120.0 mm and preferably greater than or equal to 60.0 mm and less than or equal to 80.0 mm.

In the examples of FIG. 6 and FIG. 7, two ribs 221 are provided; however, this is merely an example. One or more ribs 221 may be provided depending on the required rigidity. For example, a single rib 221 that extends in a straight line or a curved line in any direction may be provided. If a plurality of ribs 221 are provided, the plurality of ribs 221 do not necessarily intersect with each other. For example, two or more ribs 221 may be arranged in parallel approximately in the face-back direction, or may be arranged in a V shape that opens toward the face side. Alternatively, one or more ribs 221 that are approximately parallel to the face-back direction and one or more ribs 221 that are approximately perpendicular to the face-back direction may be arranged to intersect with each other.

The golf club head 1 can be manufactured by using a mold assembly and a pressure forming device, for example. The mold assembly can be assembled and disassembled, and the pressure forming device includes an openable sealed container, and a pneumatic mechanism and a heating mechanism installed in the openable sealed container.

Specifically, the golf club head 1 is manufactured by the method as described below. First, a mold assembly that can be assembled and disassembled is prepared. Then, a plurality of layers of prepregs formed of a fiber-reinforced resin are prepared, and the prepregs are attached to the mold assembly so as to be laminated to form a blank of the body 20. Note that before the prepregs are laminated, a slit may be formed in a portion of the prepregs and a portion of the prepregs may be formed in a rib shape to form the rigidity control portions.

Next, the mold assembly including the blank of the body 20 is placed in a bag. The bag is put into the openable sealed container, and heat is applied by the heating mechanism while a vacuum is created by the pneumatic mechanism. As a result, the prepregs formed of the fiber-reinforced resin, which constitute the blank of the body 20, are cured by a cross-linking reaction. After the heating, the body 20 is bonded to the preformed face 10 to form a semi-finished golf club head. The semi-finished golf club head is deburred and subjected to surface finishing to obtain the golf club head 1.

In the above-described method, when heat is applied by the heating mechanism while a vacuum is created by the pneumatic mechanism, the vacuum can be set in a range from −0.1 mbar to −1000 mbar, the heating temperature can be set in a range from 40° C. to 250° C., and the vacuum treatment and heating time can be set in a range from 1 minute to 60 minutes.

An autoclave may be used as the pressure forming device. If an autoclave is used as the pressure forming device, the autoclave is able to heat, evacuate air, and apply positive air pressure to a blank of the golf club head 1. For example, a positive air pressure value may be set in a range from 2 bar to 100 bar.

Further, the vacuum, the heating temperature, and the positive air pressure may be adjusted in accordance with the shape of a wood-type golf club head, the thickness of prepregs formed of a fiber-reinforced resin, or the like. Further, the vacuum pressure value, the heating temperature, and the positive air pressure value may also be adjusted in accordance with the cross-linking reaction of prepregs formed of a fiber-reinforced resin. That is, the shape and weight of a golf club head can be readily controlled by using a fiber-reinforced resin as the material of the body.

As described above, in the golf club head 1, at least the crown 21, the sole 22, and the hosel chamber 23 of the body 20 are formed by laminating layers of a fiber-reinforced resin. Accordingly, the rigidity of the crown 21 and the rigidity of the sole 22 can be readily adjusted in contrast to when the crown 21 and the sole 22 are formed of a metal such as titanium. The ball striking performance of the golf club head 1 is improved by controlling the rigidity of the crown 21 and the rigidity of the sole 22, which are formed of a fiber-reinforced resin. Specifically, while the slits 211 decrease the flexural rigidity in the face-back direction of the crown 21, the ribs 221 increase the flexural rigidity in the face-back direction of the sole 22. Accordingly, the crown 21 readily deflects by the impact of a golf ball, and thus the launch angle of the golf ball can be increased.

For a golf club head in which the body 20 is formed of a metal such as titanium, there may be many limitations depending on the manufacturing method (casting or forging). Particularly, if the thickness of a predetermined portion is increased in order to partially increase the flexural rigidity, the weight of the predetermined portion would be increased. As a result, the degree of freedom in designing functions of the head would be reduced. Similarly, if the thickness of a predetermined portion is decreased in order to partially decrease the flexural rigidity, the structural strength of the head would be reduced. As a result, the head would be susceptible to damage from impact when hitting a ball. Therefore, it would not be easy to decrease the rigidity of a crown 21 and increase the rigidity of a sole 22 while reducing the influence on other elements. Thus, rigidity control would be limited to a narrow range.

In contrast, in the above-described manufacturing method in which a fiber-reinforced resin is used as the material of the body 20, prepregs including fibers having various elastic moduli may be used, prepregs having different ratios of fibers to a resin may be used, prepregs may be formed in various shapes, or prepregs may be combined with a different material (such as a metal wire, metal mesh, or a blowing agent). Accordingly, rigidity can be designed in a wider range, not achievable if the body 20 were formed of a metal such as titanium. As a result, golf clubs with suitable characteristics can be provided to golfers with different swing types.

In the present embodiment, the slits 211 are adopted as rigidity control portions that decrease the flexural rigidity mainly in the face-back direction while reducing the influence on the flexural rigidity in the toe-heel direction, and the ribs 221 are adopted as rigidity control portions that increase the flexural rigidity in the face-back direction. However, the present invention is not limited thereto, and the slits 211 are not necessarily formed. For example, a low elasticity material may be provided or a prepreg sheet cut in a rectangular shape and having slit-like openings may be provided in a portion where the slits 211 are formed as illustrated in FIG. 3. Further, metal wires or metal mesh may be adopted instead of the ribs 221. Alternatively, the ribs 221 may be metal pieces, or may be metal pieces covered by a fiber-reinforced resin. Examples of low elasticity materials include resins, rubber, and fiber-reinforced resins.

In the present embodiment, the rigidity control portions that decrease the flexural rigidity mainly in the face-back direction while reducing the influence on the flexural rigidity in the toe-heel direction are provided in the crown 21, and the rigidity control portions that increase the flexural rigidity in the face-back direction are provided in the sole 22. However, the present invention is not limited thereto, and rigidity control portions that increase the flexural rigidity mainly in the face-back direction while reducing the influence on the flexural rigidity in the toe-heel direction may be provided in the crown 21, and rigidity control portions that decrease the flexural rigidity mainly in the face-back direction while reducing the influence on the flexural rigidity in the toe-heel direction may be provided in the sole 22. In this case, the effect for preventing a ball from being hit too high can be provided.

First Modification of First Embodiment

In a first modification of the first embodiment, a golf club head that includes a connector to which/from which a rod is attachable/detachable will be described. In the first modification of the first embodiment, a description of elements identical to those in the above-described embodiment may be omitted.

Figure 8:
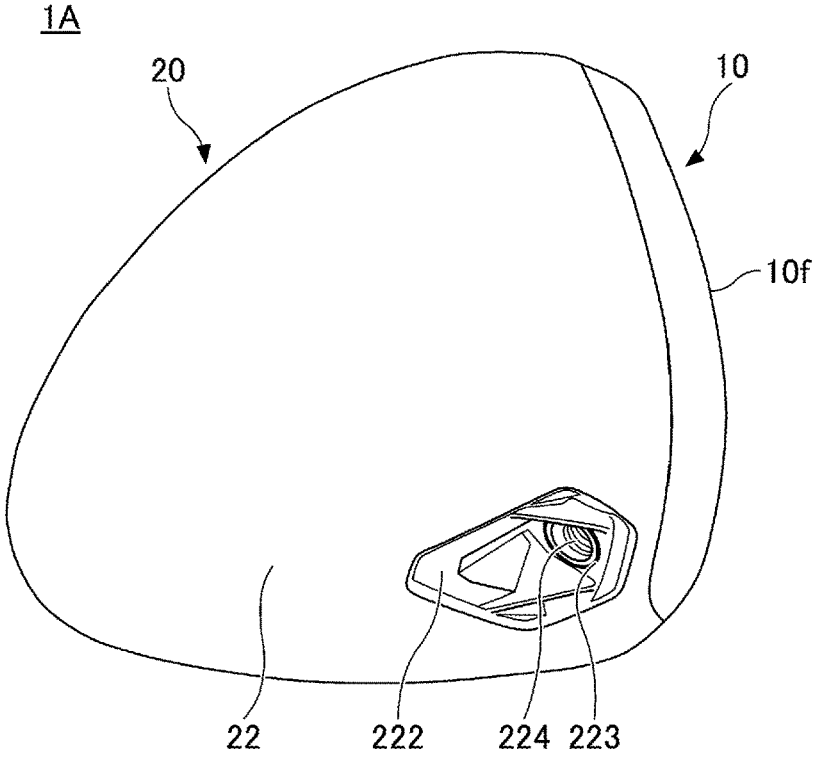
FIG. 8 is a perspective view of a golf club head 1A when viewed from the bottom side according to a first modification of the first embodiment.
Figure 9:
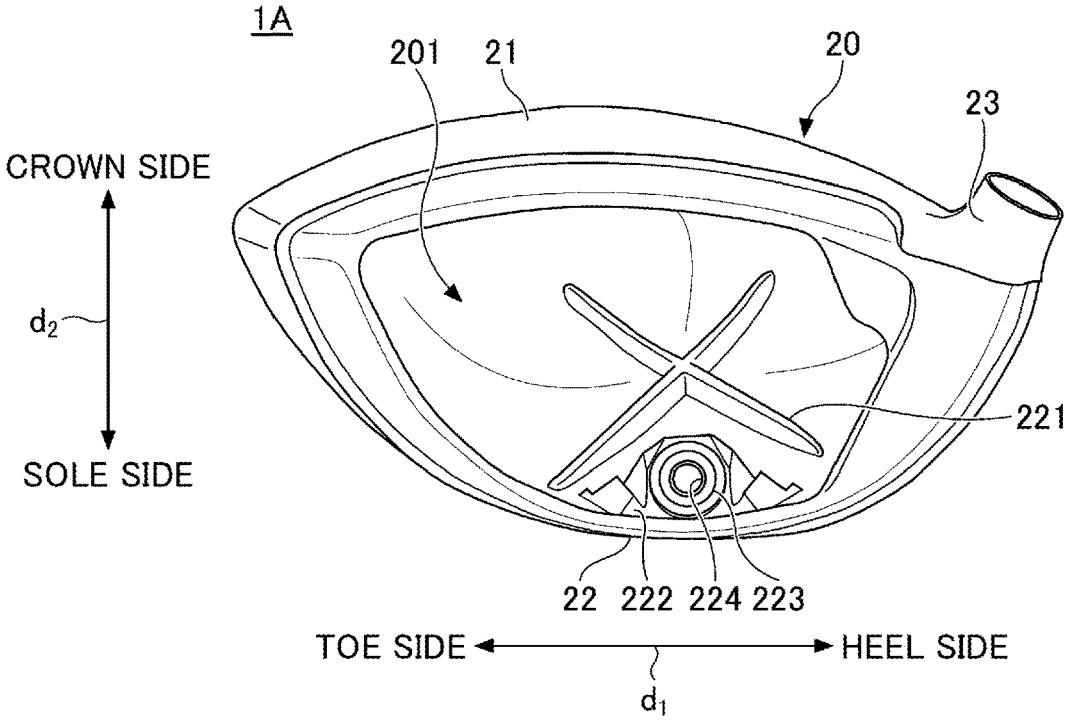
FIG. 9 is a front view of a body of the golf club head 1A according to the first modification of the first embodiment.

FIG. 8 is a perspective view of a golf club head 1A when viewed from the bottom side according to the first modification of the first embodiment. FIG. 9 is a front view of a body of the golf club head 1A according to the first modification of the first embodiment. Similar to the first embodiment, the sole 22 may include two ribs 221 that protrude inwardly from the inner surface of the sole 22. The ribs 221 serve as rigidity control portions that increase the flexural rigidity in the face-back direction.

Unlike the first embodiment, in the golf club head 1A, a recessed portion 222 is provided in the sole 22. The recessed portion 222 is recessed from the outer surface side toward the inner surface side of the sole 22. When viewed in the crown-sole direction, the two ribs 221 are positioned so as not to overlap with the recessed portion 222, and are positioned in the vicinity of the recessed portion 222. By positioning the ribs 221 in the vicinity of the recessed portion 222, the vicinity of the recessed portion 222 having a low rigidity can be efficiently reinforced.

The recessed portion 222 includes a connector 223 that is made of metal and to which/from which a rod 90 is attachable/detachable. The face 10 is, for example, made of metal, and the face 10 is apart from the connector 223. FIG. 8 and FIG. 9 depict a state in which the rod 90 is not attached to the connector 223.

The connector 223 is formed integrally with a fiber-reinforced resin of the sole 22. In order to form the connector 223 integrally with the fiber-reinforced resin of the sole 22, the connector 223 may be placed within a blank of the body 20 when the blank of the body 20 is formed by attaching a plurality of prepregs to a mold assembly such that the plurality of prepregs are laminated. Specifically, the connector 223 may be bonded to the prepregs, or the connector 223 may be covered by the prepregs.

The connector 223 includes a female thread 224. The connector 223 is located approximately at the center of the sole 22 in the toe-heel direction of the sole 22, and is located on the face 10 side of the sole 22. For example, titanium, a titanium alloy, aluminum, an aluminum alloy, tungsten, a tungsten alloy, stainless steel, or the like may be used as the material of the connector 223.

Figure 10:
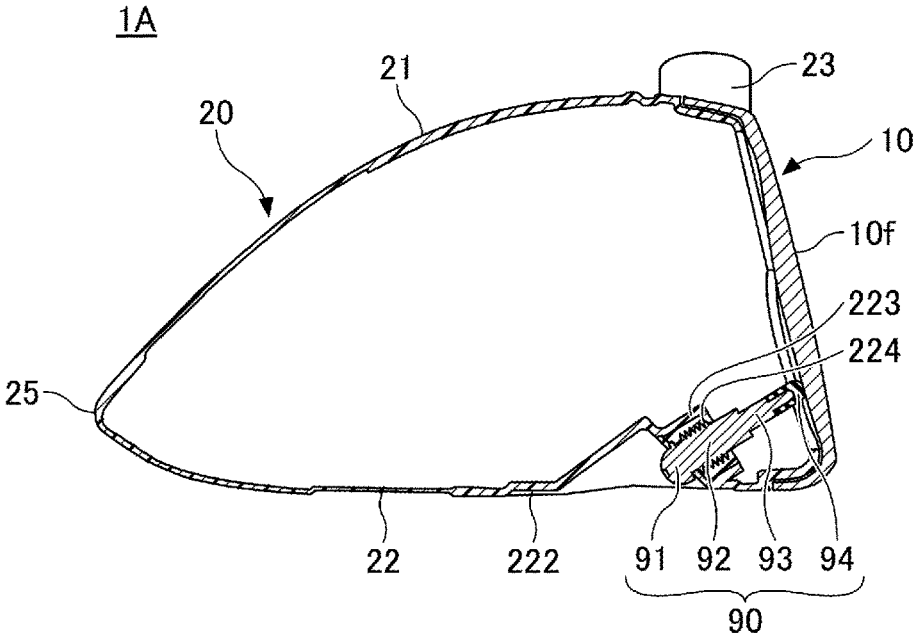
FIG. 10 is a cross-sectional view (part 1) of the golf club head 1A according to the first modification of the first embodiment.

FIG. 10 is a cross-sectional view (part 1) of the golf club head 1A according to the first modification of the first embodiment. In FIG. 10, the rod 90 is attached to the connector 223. The rod 90 illustrated in FIG. 10 is attachable to and detachable from the connector 223. For example, the rod 90 includes a head 91, a male thread 92, a cylindrical portion 93, and a cap 94. The male thread 92 is provided on one side of the head 91 concentrically with the head 91. The cylindrical portion 93 is provided on one side of the male thread 92 concentrically with the head 91 and the male thread 92. The tip side of the cylindrical portion 93 is reduced in diameter and is covered by the cap 94.

For example, a metallic material such as titanium, a titanium alloy, aluminum, tungsten, a tungsten alloy, stainless steel, or a ferrous metal may be used as the material of each of the head 91, the male thread 92, and the cylindrical portion 93. For example, a non-metallic material such as a resin, rubber, or a fiber-reinforced plastic (FRP) may be used as the material of the cap 94.

The head 91 of the rod 90 may be provided with a hexagonal groove, for example. The male thread 92 of the rod 90 can be screwed into the female thread 224 of the connector 223 by inserting the tip of a hex wrench or the like into the groove of the head 91 of the rod 90 and causing the rod 90 to rotate. The rod 90 is screwed into the connector 223 such that the rod 90 extends from the recessed portion 222 toward the back surface of the face 10, and the cap 94 contacts the back surface of the face 10.

That is, when the rod 90 is attached to the connector 223, the cylindrical portion 93, which is a metallic member, indirectly contacts the back surface of the face 10 via the cap 94, which is a non-metallic member. In other words, the total length of the rod 90 and the position of the connector 223 are designed such that the cap 94 at the tip of the rod 90 contacts the back surface of the face 10.

Figure 11:
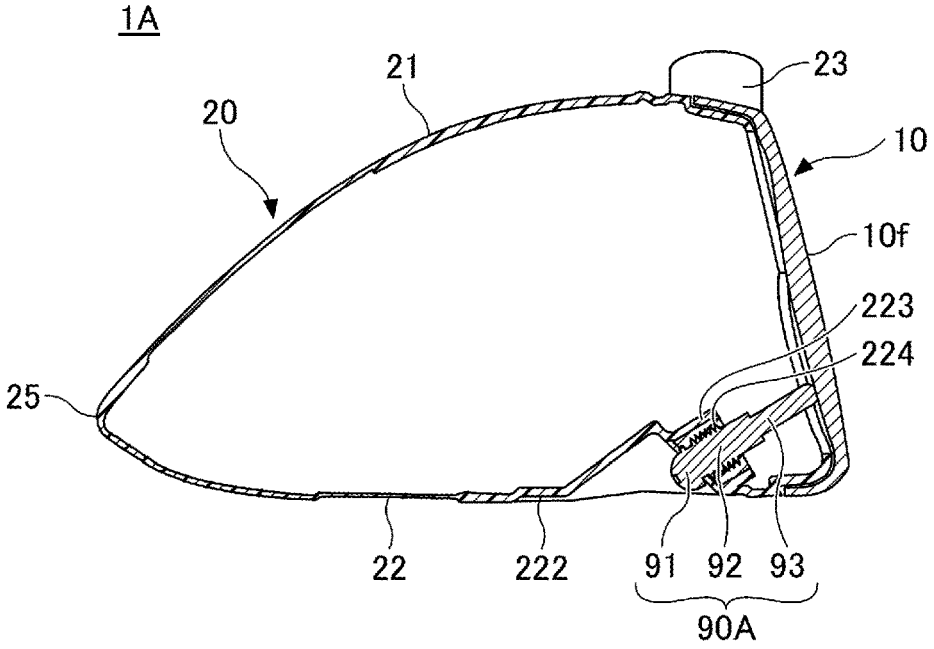
FIG. 11 is a cross-sectional view (part 2) of the golf club head 1A according to the first modification of the first embodiment.

The rod may be configured as illustrated in FIG. 11. FIG. 11 is a cross-sectional view (part 2) of the golf club head 1A according to the first modification of the first embodiment. In FIG. 11, a rod 90A is attached to the connector 223. The rod 90A illustrated in FIG. 11 is attachable to and detachable from the connector 223. The rod 90A differs from the rod 90 in that the rod 90A does not include the cap 94. In addition, because the cap 94 is not included, the tip of the cylindrical portion 93 is not reduced in diameter.

In FIG. 11, when the rod 90A is attached to the connector 223, the tip of the cylindrical portion 93 of the rod 90A contacts the back surface of the face 10. In other words, the total length of the rod 90A and the position of the connector 223 are designed such that the tip of the cylindrical portion 93 of the rod 90A contacts the back surface of the face 10.

As described above, the tip of the rod 90 or the rod 90A contacts the back surface of the face 10, thereby restricting the deformation of a contact portion between the face 10 and the rod 90 or the rod 90A. That is, the rod 90 and the rod 90A each function as a reinforcing member that restricts the local deformation of the face 10. The tip of the rod 90 or the rod 90A is tapered so as to make point contact with the back surface of the face 10, thus preventing the deformation of the face 10 from being excessively restricted.

The tip cf the rod 90 or the rod 90A may contact the back surface of the face 10 so as not to press the back surface of the face 10 in a natural state, or may contact the back surface of the face 10 so as to press the back surface of the face 10 toward the face surface 10*f* side. In addition, the degree of pressing the back surface of the face 10 may be adjusted in accordance with the degree of tightening of the male thread 92 to the connector 223. If the male thread 92 is tightened to the maximum extent, the tip of the rod 90 or the rod 90A may slightly displace the back surface of the face 10 toward the face surface 10*f* side.

With regard to the rigidity distribution of the face 10, restricting the deformation of the contact portion between the face 10 and the rod 90 or the rod 90A causes the rigidity from the center portion to the upper portion of the face 10 to be relatively low and causes the rigidity of the lower portion of the face 10 to be relatively high. That is, the upper portion of the face 10 readily deflects toward the back side by the impact of a golf ball. Accordingly, the launch angle of the golf ball can be increased.

Further, the weight of the rod 90 or the rod 90A causes the center of gravity of the golf club head 1A to be located on the face 10 side. Accordingly, the amount of backspin of a golf ball tends to be reduced, and thus the maximum flight distance of the golf ball can be increased.

As described above, in the golf club head 1A, at least the sole 22 of the body 20 is formed by laminating layers of a fiber-reinforced resin. Therefore, the connector 223 made of metal can be readily embedded into the sole 22. Further, the rod 90 or the rod 90A is attached to the connector 223 such that the tip of the rod 90 or the rod 90A contacts the back surface of the face 10, thereby allowing the deformation of the face 10 to be restricted. The upper limit of the resilience of the face 10 is defined by the official rules of golf. However, by causing the tip of the rod 90 or the rod 90A to contact the back surface of the face 10 such that the deformation of the face 10 is restricted, the resilience of the face 10 can be intentionally reduced. As a result, the golf club head 1A can be designed to have a higher resilience over a wider range than conventional designs.

Further, as described above, the rod 90 or the rod 90A is attached to the connector 223 such that the tip of the rod 90 or the rod 90A contacts the back surface of the face 10, thereby allowing the deformation of the face 10 to be restricted. Accordingly, the upper portion of the face 10 readily deflects toward the back side by the impact of a golf ball, and thus the launch angle of the golf ball can be further increased. Further, because the crown 21 is formed by laminating layers of a fiber-reinforced resin, the crown 21 is more readily deflected. As a result, an initial velocity can be increased as compared to the related-art.

In the above, an example in which the rod 90 or the rod 90A is attached to the connector 223 has been described. However, a threaded weight member may be attached to the connector 223 instead of the rod 90 or the rod 90A. Similar to the rods 90 and 90A, the weight member can be configured to include a male thread; however, the tip of the weight member does not necessarily contact the face. Further, a plurality of weight members having different weights may be prepared, and the position of the center of gravity of the golf club head 1A can be adjusted by varying a weight member attached to the connector 223. Further, a plurality of connectors may be provided in the sole 22, and two or more weight members may be attached to the connectors.

Second Modification of First Embodiment

In a second modification of the first embodiment, a golf club head in which a metal hosel is attached to the hosel chamber 23 will be described. In the second modification of the first embodiment, descriptions of elements identical to those in the above-described embodiment may be omitted.

Figure 12:
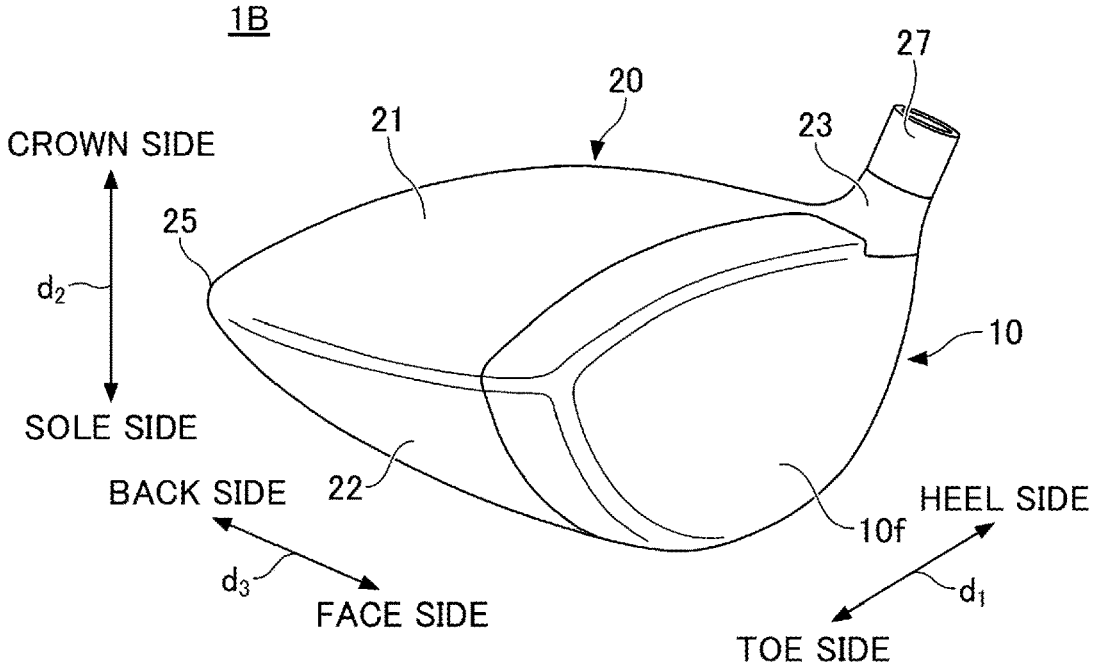
FIG. 12 is a perspective view of a golf club head 1B according to a second modification of the first embodiment.
Figure 13:
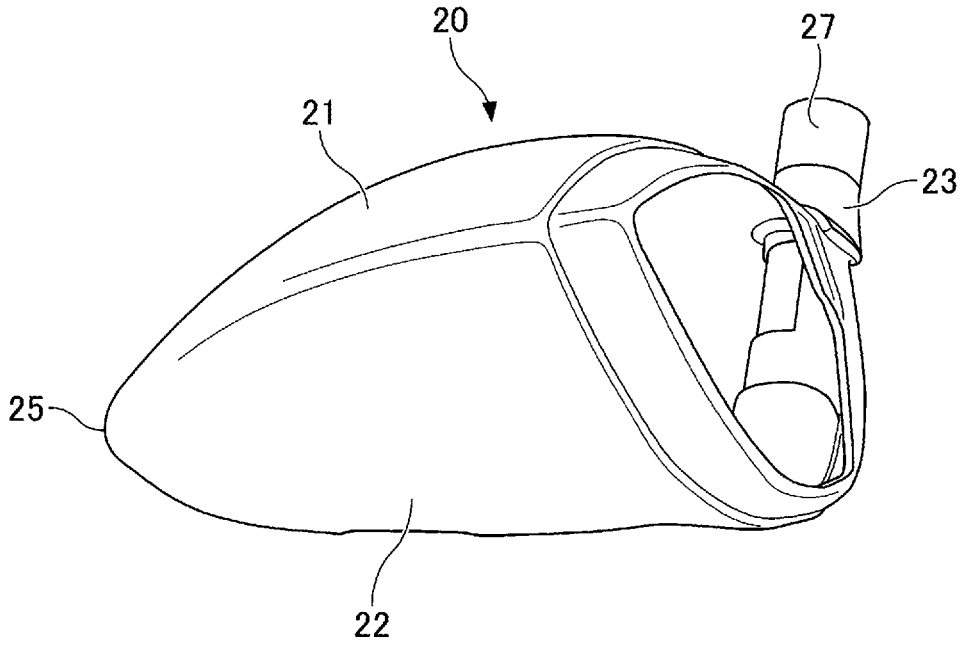
FIG. 13 is a perspective view of a body of the golf club head 1B according to the second modification of the first embodiment.
Figure 14:
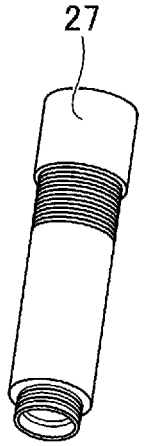
FIG. 14 is a perspective view of a metal hosel 27.

FIG. 12 is a perspective view of a golf club head 1B according to the second modification of the first embodiment. FIG. 13 is a perspective view of a body of the golf club head 1B according to the second modification of the first embodiment. FIG. 14 is a perspective view of a metal hosel 27.

As illustrated in FIG. 12 through FIG. 14, in the golf club head 1B, at least the crown 21, the sole 22, and the hosel chamber 23 of the body 20 are formed by laminating layers of a fiber-reinforced resin.

In the golf club head 1B, the hosel chamber 23 extends through the body 2C and to the sole 22. The hosel chamber 23 has a hollow cylindrical shape and houses the metal hosel 27. A large diameter portion on one end side of the metal hosel 27 is exposed from the hose: chamber 23. A portion of the hosel chamber 23 located within the body 20 is cut out to expose the side surface of the metal hosel 27.

The metal hosel 27 may be a member having a hollow cylindrical shape. For example, titanium, a titanium alloy, aluminum, an aluminum alloy, tungsten, a tungsten alloy, stainless steel, or the like may be used as the material of the metal hosel 27. The metal hosel 27 may be integrally formed with the fiber-reinforced resin included in the body 20.

In order to form the metal hosel 27 integrally with the fiber-reinforced resin included in the body 20, the metal hosel 27 may be placed within a blank of the body 20 when the blank of the body 20 is formed by attaching a plurality of prepregs to a mold assembly such that the plurality of prepregs are laminated. Specifically, the metal hosel 27 may be bonded to the prepregs, or the metal hosel 27 may be covered by the prepregs.

In this manner, in the golf club head 1B, at least the crown 21, the sole 22, and the hosel chamber 23 of the body 20 are formed by laminating layers of a fiber-reinforced resin. Therefore, the metal hosel 27 can be readily embedded into the body 20. By embedding the metal hosel 27, the strength of the metal hosel 27 can be enhanced as compared to when a hosel formed of a resin is used.

Figure 15:
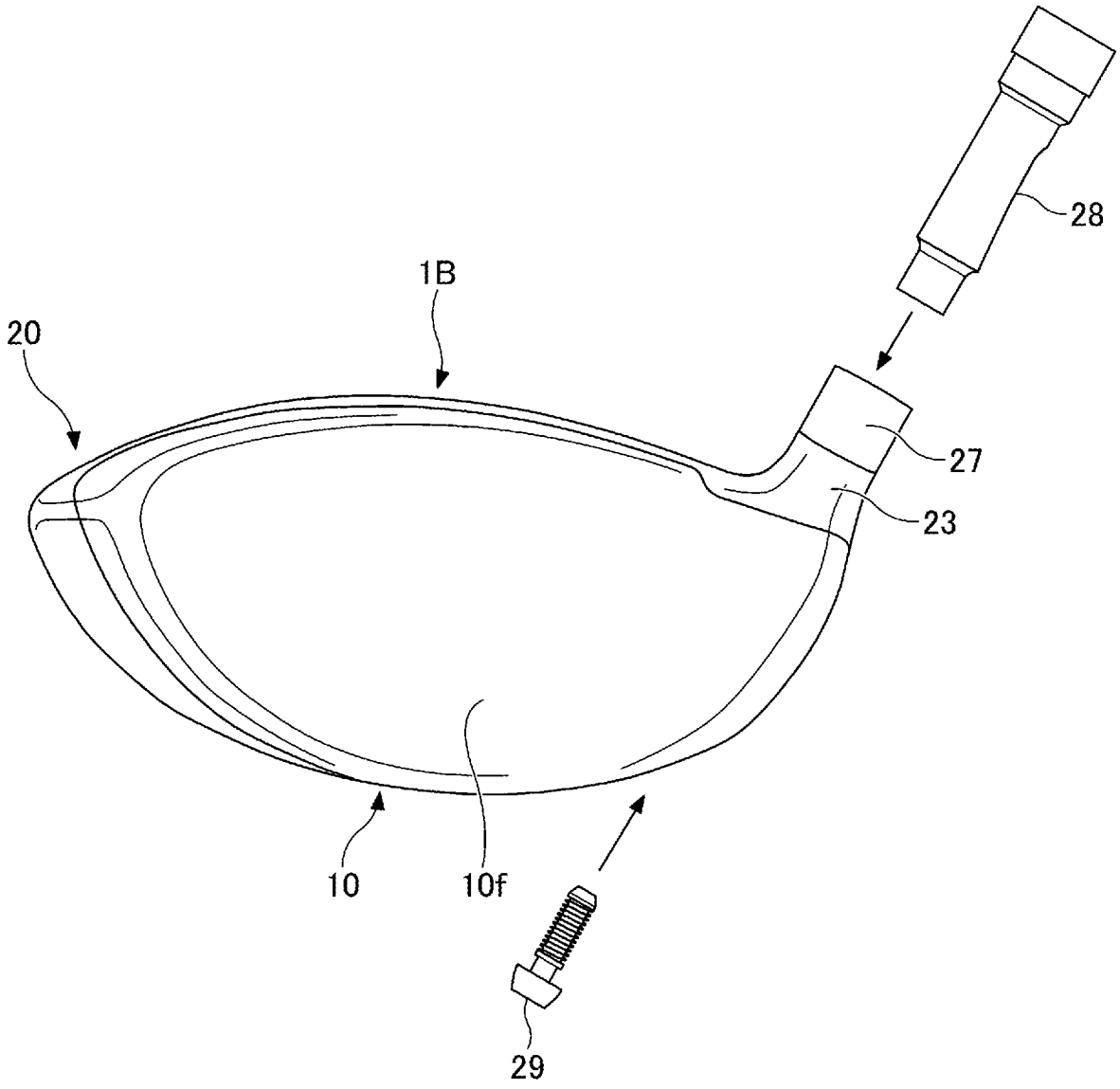
FIG. 15 is a diagram illustrating a variable shaft adjustability mechanism.

The golf club head 1B may have a variable shaft adjustability mechanism. The variable shaft adjustability mechanism may include the metal hosel 27, a shaft case 28, and an attachment screw 29 as illustrated in FIG. 15. Specifically, the shaft case 28 is housed within the metal hosel 27 and is removably attached to the metal hosel 27 by the attachment screw 29 from the sole 22 side. For example, the shaft case 28 may be affixed to a shaft with an adhesive.

One or both of a hole of the metal hosel 27 and a hole of the shaft case 28 may be eccentric. Therefore, attaching the shaft case 28 to the metal hosel 27 by causing the shaft case 28 to rotate in a circumferential direction allows the positional relationship between the golf club head 1B and the shaft (for example, a lie angle, a face angle, and the like) to be adjusted.

Second Embodiment

Next, a second embodiment of the present disclosure will be described. In the second embodiment, differences from the first embodiment will be described, and a description of elements having the same configuration and functions as those of the first embodiment may be omitted.

Figure 16:
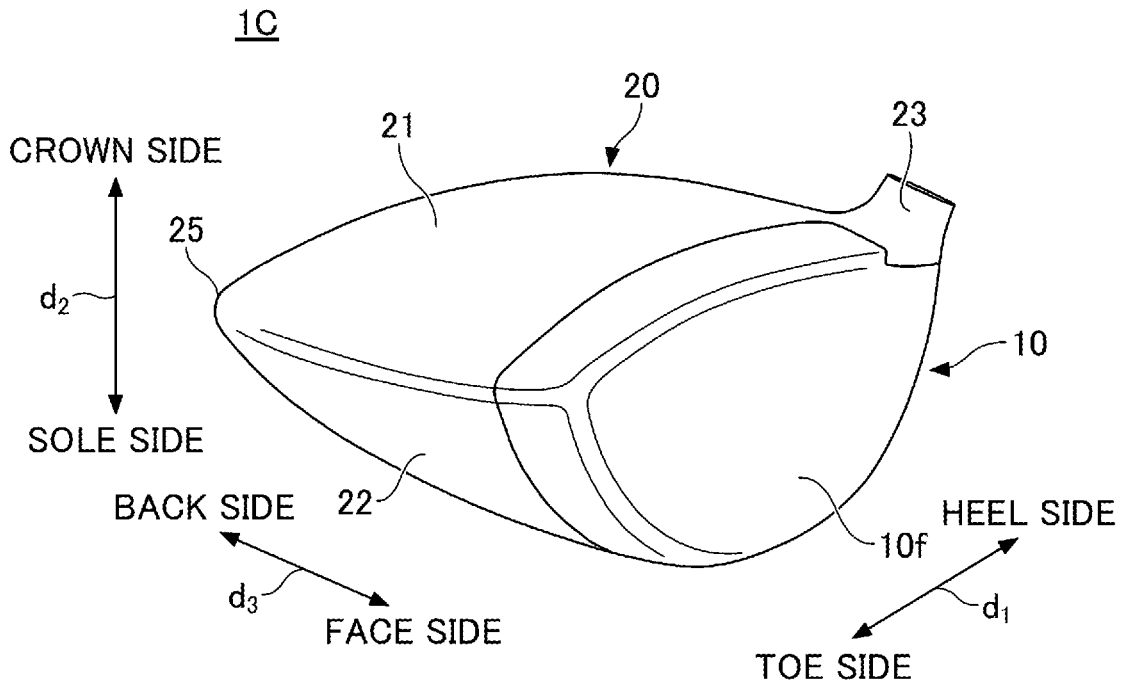
FIG. 16 is a perspective view of a golf club head 10 according to a second embodiment.
Figure 17:
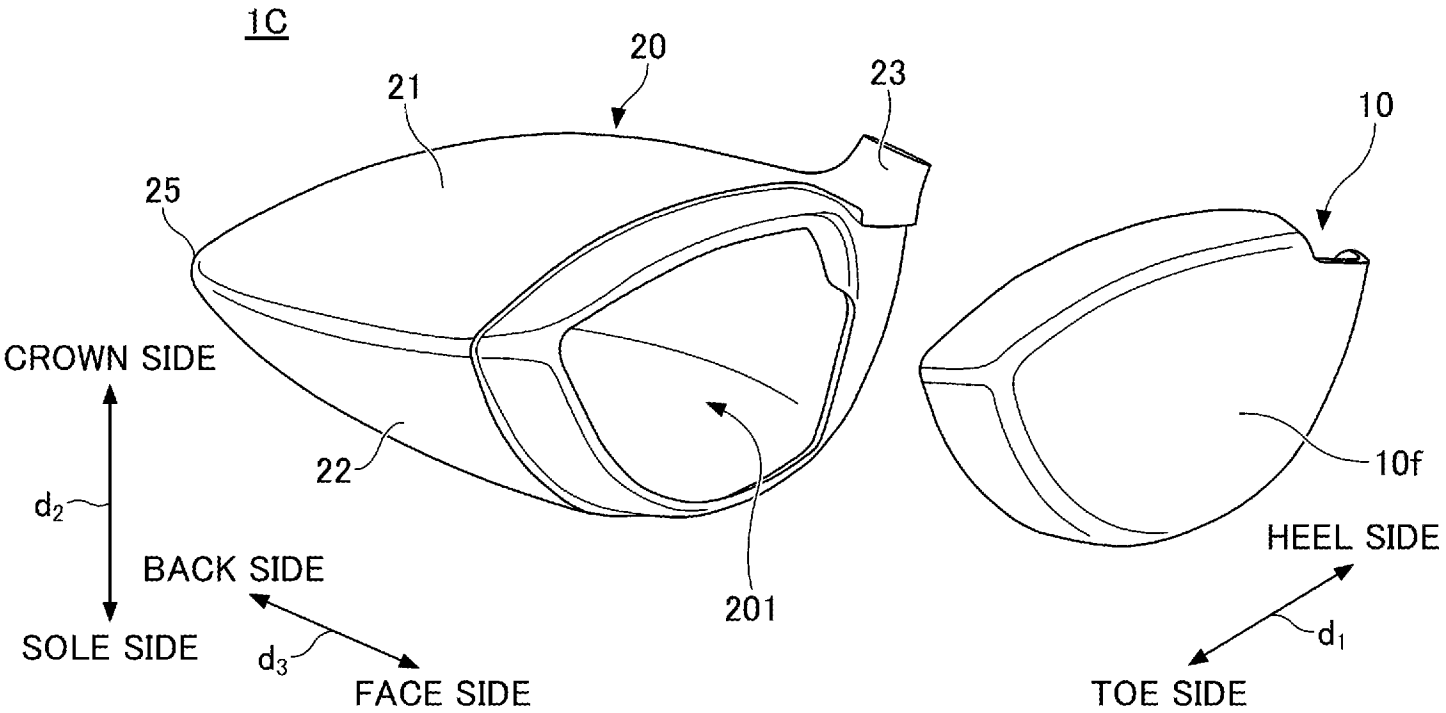
FIG. 17 is an exploded perspective view of the golf club head 10 according to the second embodiment.

FIG. 16 is a perspective view of a golf club head 10 according to the second embodiment. FIG. 17 is an exploded perspective view of the golf club head 10 according to the second embodiment.

The golf club head 10 depicted in FIG. 16 and FIG. 17 is a wood-type golf club head such as a driver club head, but may be a hybrid club head or fairway wood club head. The golf club head 10 includes a face 10 and a body 20, and has a hollow structure in which the face 10 is joined to and integrated with the body 20.

The body 20 includes a crown 21, a sole 22, and a hosel chamber 23. In the body 20, at least the sole 22 is formed by laminating layers of a fiber-reinforced resin. The sole 22 can be formed by laminating layers of a carbon fiber-reinforced resin. Note that if the face 10 is formed of a fiber-reinforced resin, the sole 22 may be formed of the same fiber-reinforced resin as the face 10.

Further, the crown 21 may be formed by laminating layers of a fiber-reinforced resin. The hosel chamber 23 may be formed by laminating layers of a fiber-reinforced resin. The crown 21, the sole 22, and the hosel chamber 23 may be integrally formed by laminating layers of a fiber-reinforced resin.

A weight port configured to receive a weight member may be provided in the sole 22. In this case, it is preferable to provide a recessed portion in the sole 22 to prevent the weight member affixed to the weight port from protruding past the external surface of the sole 22. A plurality of weight members having different weights may be prepared, and the position of the center of gravity of the golf club head 1C can be adjusted by varying a weight member affixed to the weight port.

The sole 22 includes a connector 223 and a female thread 224. The connector 223, the female thread 224, and a rod removably attached to the connector 223 will be described with reference to FIG. 18 through FIG. 21 in addition to FIG. 16 and FIG. 17.

Figure 18:
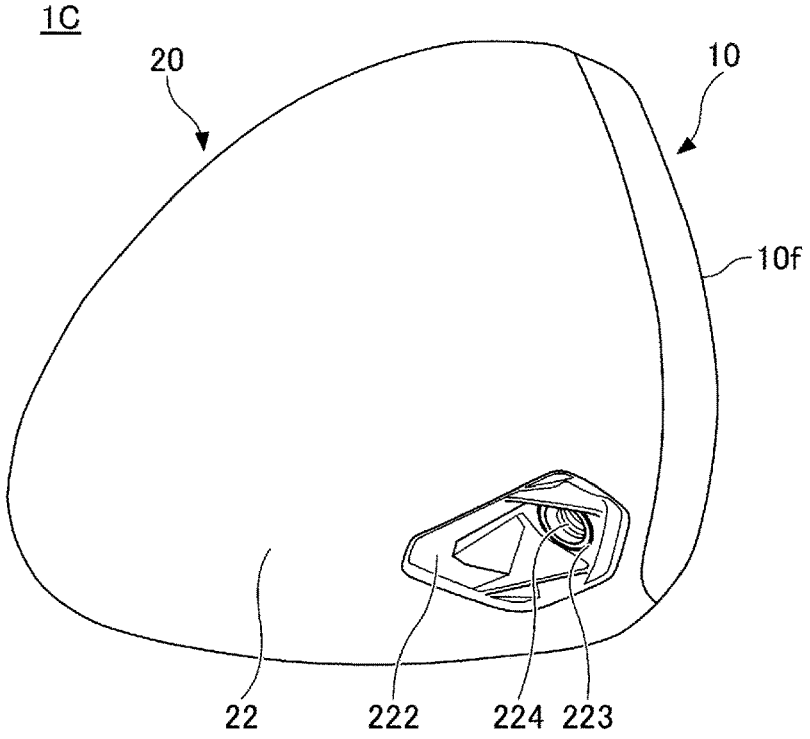
FIG. 18 is a perspective view of the golf club head 10 when viewed from the bottom side according to the second embodiment.
Figure 19:
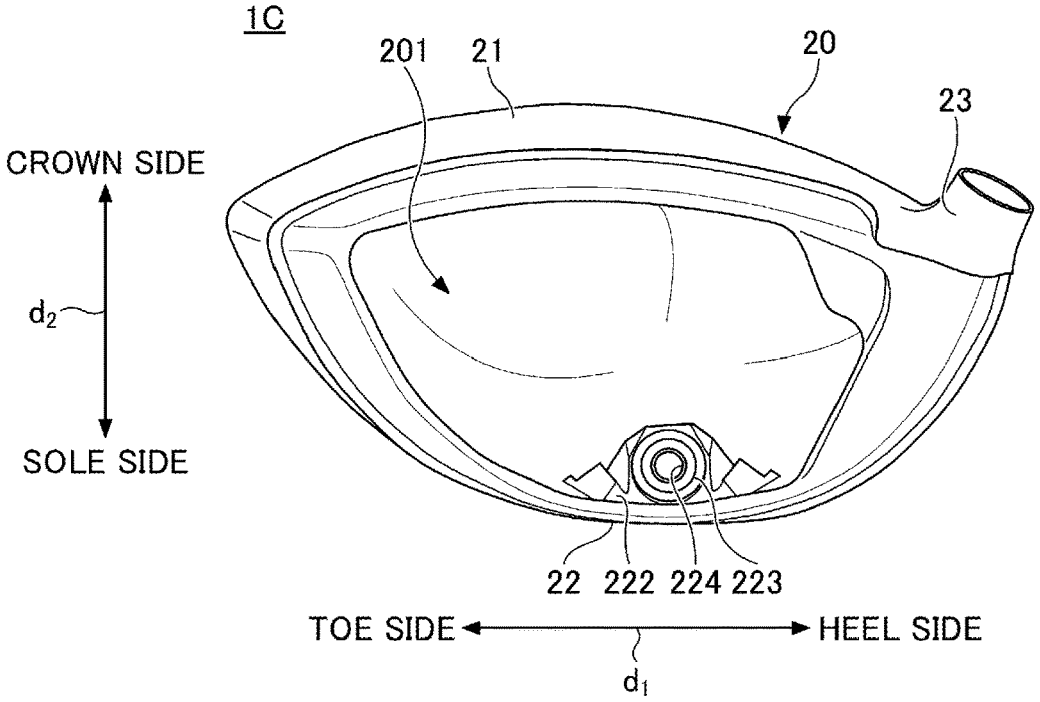
FIG. 19 is a front view of a body of the golf club head 10 according to the second embodiment.

FIG. 18 is a perspective view of the golf club head 1C when viewed from the bottom side according to the second embodiment. FIG. 19 is a front view of the body 20 of the golf club head 1C according to the second embodiment. As illustrated in FIG. 18 and FIG. 19, a recessed portion 222 is provided in the sole 22. The recessed portion 222 is recessed from the outer surface side toward the inner surface side of the sole 22. The recessed portion 222 includes a connector 223 that is made of metal and to which a rod 90 is attachable. The face 10 is, for example, made of metal, and the face 10 is apart from the connector 223. FIG. 18 and FIG. 19 depict a state in which the rod 90 is not attached to the connector 223.

The connector 223 is formed integrally with the fiber-reinforced resin of the sole 22. The connector 223 includes a female thread 224. The connector 223 is located approximately at the center of the sole 22 in the toe-heel direction, and is located on the face 10 side of the sole 22 in the face-back direction. For example, titanium, a titanium alloy, aluminum, an aluminum alloy, tungsten, a tungsten alloy, stainless steel, or the Like may be used as the material of the connector 223.

Figure 20:
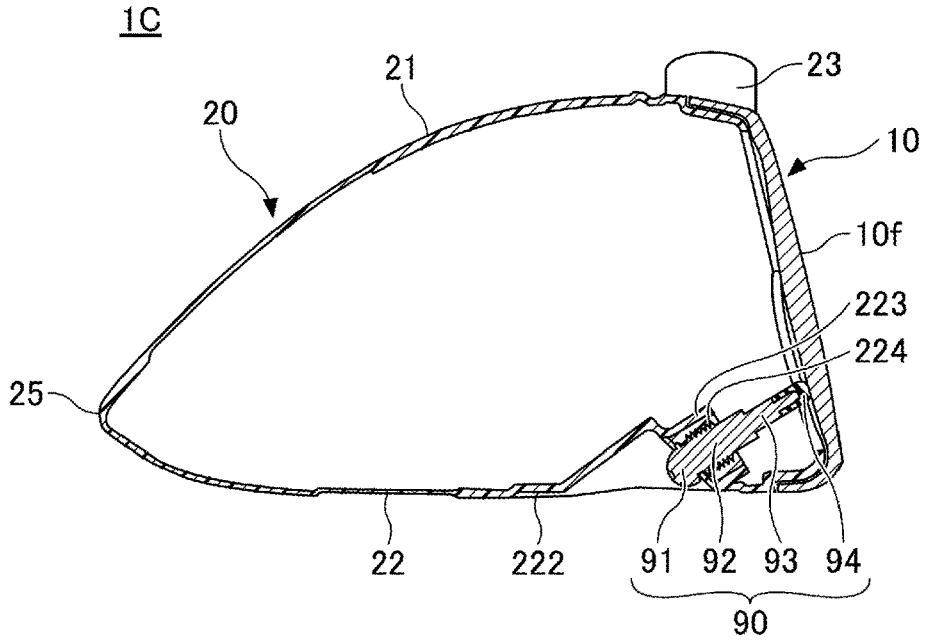
FIG. 20 is a cross-sectional view (part 1) of the golf club head 10 according to the second embodiment.

FIG. 20 is a cross-sectional view (part 1) of the golf club head 10 according to the second embodiment. In FIG. 20, the rod 90 is attached to the connector 223. The rod 90 illustrated in FIG. 20 is attachable to and detachable from the connector 223. For example, the rod 90 includes a head 91, a male thread 92, a cylindrical portion 93, and a cap 94. The male thread 92 is provided on one side of the head 91 concentrically with the head 91. The cylindrical portion 93 is provided on one side of the male thread 92 concentrically with the head 91 and the male thread 92. The tip of the cylindrical portion 93 is reduced in diameter and is covered by the cap 94.

For example, a metallic material such as titanium, a titanium alloy, aluminum, tungsten, a tungsten alloy, stainless steel, or a ferrous metal may be used as the material of each of the head 91, the male thread 92, and the cylindrical portion 93. For example, a non-metallic material such as a resin, rubber, or fiber-reinforced plastic (FRP) may be used as the material of the cap 94.

The head 91 of the rod 90 may be provided with a hexagonal groove, for example. The male thread 92 of the rod 90 can be screwed into the female thread 224 of the connector 223 by inserting the tip of a hex wrench or the like into the groove of the head 91 of the rod 90 and causing the rod 90 to rotate. The rod 90 is screwed into the connector 223 such that the rod 90 extends from the recessed portion 222 toward the back surface of the face 10, and the cap 94 contacts the back surface of the face 10.

That is, when the rod 90 is attached to the connector 223, the cylindrical portion 93, which is a metallic member, indirectly contacts the back surface of the face 10 via the cap 94, which is a non-metallic member. In other words, the total length of the rod 90 and the position of the connector 223 are designed such that the cap 94 at the tip of the rod 90 contacts the back surface of the face 10.

Figure 21:
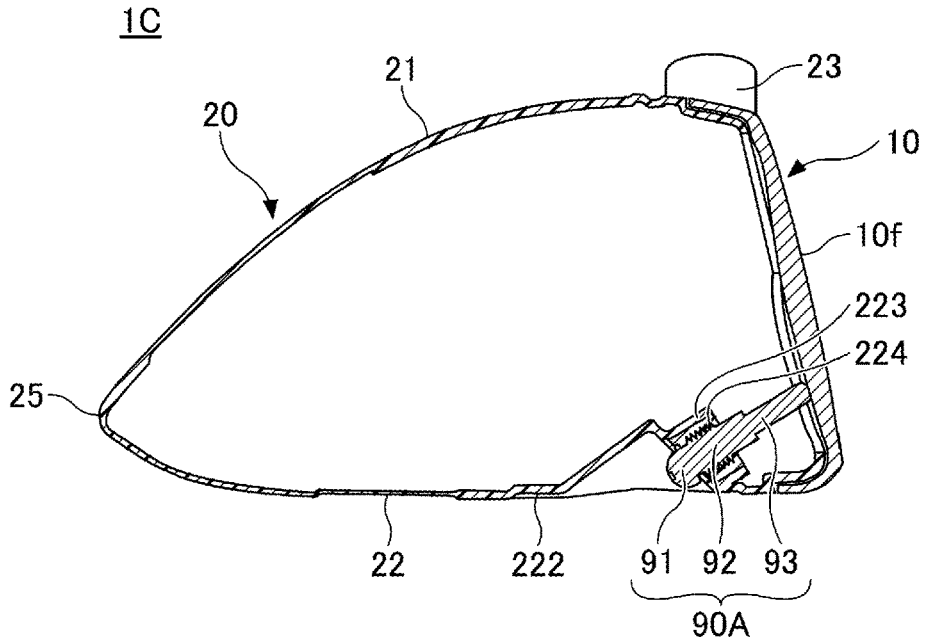
FIG. 21 is a cross-sectional view (part 2) of the golf club head 10 according to the second embodiment.

The rod may be configured as illustrated in FIG. 21. FIG. 21 is a cross-sectional view (part 2) of the golf club head 1C according to the second embodiment. In FIG. 21, a rod 90A is attached to the connector 223. The rod 90A illustrated in FIG. 21 is attachable to and detachable from the connector 223. The rod 90A differs from the rod 90 in that the rod 90A does not include the cap 94. In addition, because the cap 94 is not included, the tip side of the cylindrical portion 93 is not reduced in diameter.

In FIG. 21, when the rod 90A is attached to the connector 223, the tip of the cylindrical portion 93 of the rod 90A contacts the back surface of the face 10. In other words, the total length of the rod 90A and the position of the connector 223 are designed such that the tip of the cylindrical portion 93 of the rod 90A contacts the back surface of the face 10.

As described above, the tip of the rod 90 or the rod 90A contacts the back surface of the face 10, thereby restricting the deformation of a contact portion between the face 10 and the rod 90 or the rod 90A. That is, the rod 90 and the rod 90A each function as a reinforcing member that restricts the local deformation of the face 10. The tip of the rod 90 or the rod 90A is tapered so as to make point contact with the back surface of the face 10, thus preventing the deformation of the face 10 from being excessively restricted.

The tip of the rod 90 or the rod 90A may contact the back surface of the face 10 so as not to press the back surface of the face 10 in a natural state, or may contact the back surface of the face 10 so as to press the back surface of the face 10 toward the face surface 10*f* side. In addition, the degree of pressing the back surface of the face 10 may be adjusted in accordance with the degree of tightening of the male thread 92 to the connector 223. If the male thread 92 is tightened to the maximum extent, the tip of the rod 90 or the rod 90A may slightly displace the back surface of the face 10 toward the face surface 10*f* side.

With regard to the rigidity distribution of the face 10, restricting the deformation of the contact portion between the face 10 and the rod 90 or the rod 90A causes the rigidity from the center portion to the upper portion of the face 10 to be relatively low and causes the rigidity of the lower portion to be relatively high. That is, the upper portion of the face 10 readily deflects toward the back side when striking a golf ball. Accordingly, the launch angle of the golf ball can be increased.

Further, the weight of the rod 90 or the rod 90A causes the center of gravity of the golf club head 10 to be located on the face 10 side. Accordingly, the amount of backspin of a golf ball tends to be reduced, and thus the maximum flight distance of the golf ball can be increased.

The golf club head 10 can be manufactured by the same method as that of the first embodiment. As described above, in the golf club head 10, at least the sole 22 of the body 20 is formed by laminating layers of a fiber-reinforced resin. Therefore, the connector 223 made of metal can be readily embedded into the sole 22. Further, the rod 90 or the rod 90A is attached to the connector 223 such that the tip of the rod 90 or the rod 90A contacts the back surface of the face 10, thereby allowing the deformation of the face 10 to be restricted. The upper limit of the resilience of the face 10 is defined by the official rules of golf. However, by causing the tip of the rod 90 or the rod 90A to contact the back surface of the face 10 such that the deformation of the face 10 is restricted, the resilience of the face 10 can be intentionally reduced. As a result, the golf club head 1C can be designed to have a higher resilience over a wider range than conventional designs.

Further, as described above, the rod 90 or the rod 90A is attached to the connector 223 such that the tip of the rod 90 or the rod 90A contacts the back surface of the face 10, thereby allowing the deformation of the face 10 to be restricted. Accordingly, the upper portion of the face 10 readily deflects toward the back side when striking a golf ball, and the launch angle of the golf ball can be further increased. Further, if the crown 21 is formed by laminating layers of a fiber-reinforced resin, the crown 21 is more readily deflected. As a result, an initial velocity can be increased as compared to the related-art.

First Modification of Second Embodiment

A first modification of the second embodiment depicts an example of a golf club head in which the rigidity of a crown and the rigidity of a sole are controlled. In the first modification of the second embodiment, descriptions of elements identical to those in the above-described embodiment may be omitted.

Figure 22:
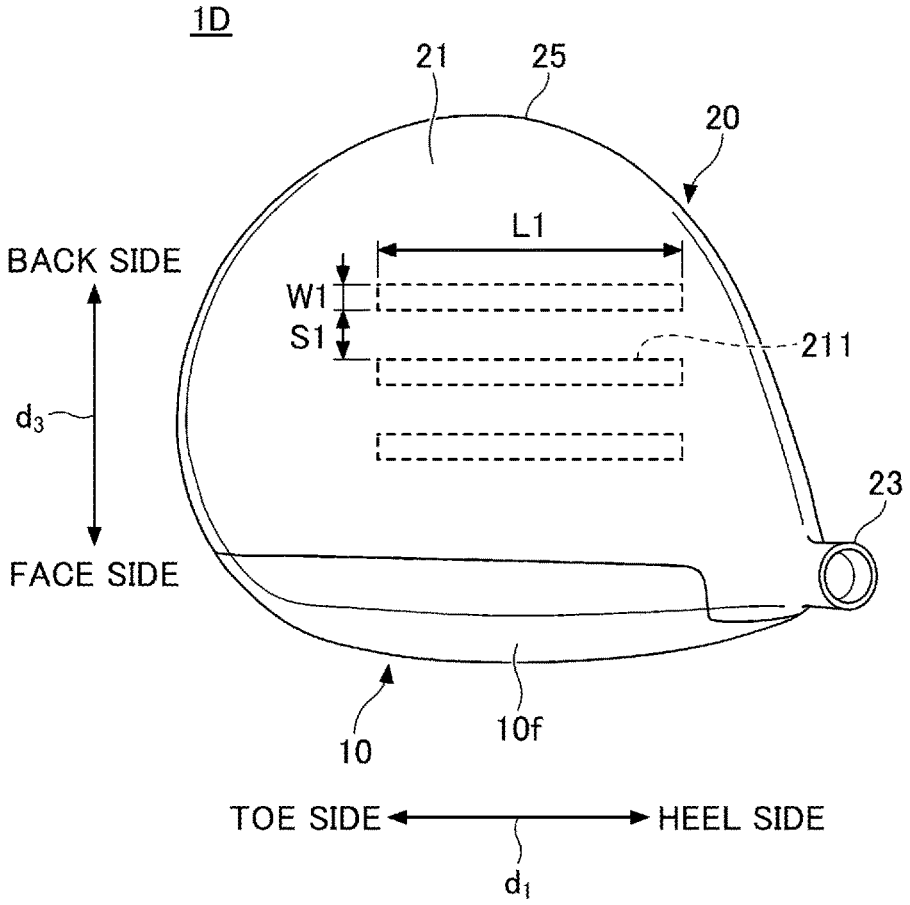
FIG. 22 is a perspective view of a golf club head 1D according to a first modification of the second embodiment.
Figure 23:
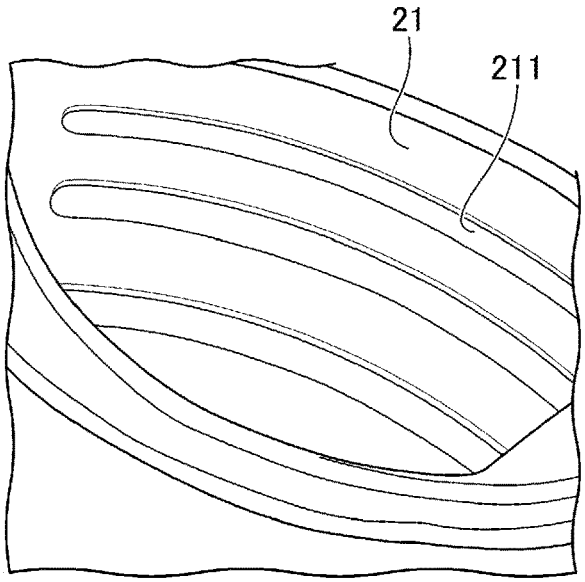
FIG. 23 is a partially enlarged view of the golf club head 1D according to the first modification of the second embodiment.

FIG. 22 is a perspective view of a golf club head 1D according to the first modification of the second embodiment. FIG. 23 is a partially enlarged view of the golf club head 1D according to the first modification of the second embodiment. As illustrated in FIG. 22 and FIG. 23, in the golf club head 1D, at least a crown 21, a sole 22, and a hosel chamber 23 of a body 20 are formed by laminating layers of a fiber-reinforced resin. Further, the crown 21 includes three thin slits 211.

The slits 211 are recessed portions that are elongated to extend in the toe-heel direction and are recessed from the inner surface of the crown 21 toward the outer surface of the crown 21. The slits 211 are arranged at predetermined intervals. The slits 211 serve as rigidity control portions that decrease the flexural rigidity mainly in the face-back direction while reducing the influence on the flexural rigidity in the toe-heel direction.

Each of the slits 211 has a width W1, for example, greater than or equal to 1.0 mm and less than or equal to 10.0 mm and preferably greater than or equal to 2.0 mm and less than or equal to 5.0 mm. The distance S1 between two adjacent slits 211 may be, for example, greater than or equal to 1.0 mm and less than or equal to 20.0 mm and preferably greater than or equal to 3.0 mm and less than or equal to 8.0 mm. Each of the slits 211 may have a depth, for example, greater than or equal to 0.1 mm and less than or equal to 1.0 mm and preferably greater than or equal to 0.2 mm and less than or equal to 0.4 mm. Each of the slits 211 may have a length L1, for example, greater than or equal to 10.0 mm and less than or equal to 120.0 mm and preferably greater than or equal to 40.0 mm and less than or equal to 80.0 mm.

In FIG. 22, the three slits 211 are provided; however, this is merely an example. At least one slit 211 may be provided, and preferably, a plurality of slits 211 may be provided. Any number of slits can be provided depending on the required rigidity. As the number of slits 211 increases, the rigidity of the crown 21 decreases as long as the slits 211 have the same width, length, and depth.

Figure 24:
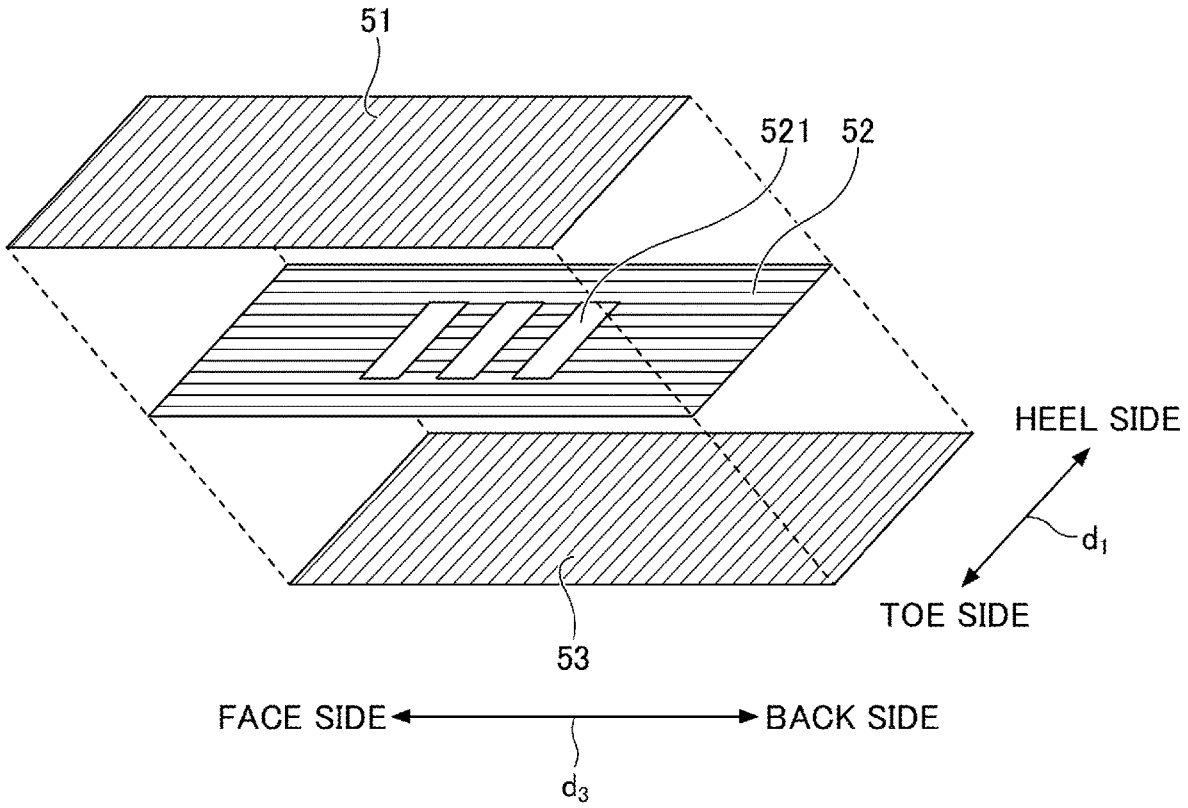
FIG. 24 is a diagram illustrating a specific configuration of rigidity control portions of a crown 21.

The crown 21 may be formed by laminating three layers of prepregs as illustrated in FIG. 24 while heating and applying pressure to the prepregs. However, the crown 21 may be formed by laminating more than three layers of prepregs.

In FIG. 24, UD prepregs in which reinforcing fibers are unidirectionally oriented and impregnated with a resin may be used as prepregs 51 and 53, which are located at the top and the bottom of the crown 21. The fibers in the prepregs 51 and 53 may be oriented in the approximately toe-heel direction. However, UD prepregs in which fibers are oriented to be inclined with respect to the toe-heel direction, or prepregs in which reinforcing fibers are woven vertically and horizontally and impregnated with a resin may also be used as the prepregs 51 and 53.

As the prepreg 52 sandwiched between the prepregs 51 and 53, a UD prepreg in which reinforcing fibers are unidirectionally oriented and impregnated with a resin may be used. The fibers in the prepreg 52 are oriented approximately in the face-back direction. The prepreg 52 is provided with three slits 521. When the prepregs 51 through 53 are processed, the slits 521 function as the slits 211.

As described above, the UD prepreg in which the fibers are oriented approximately in the face-back direction is used as the prepreg 52, and the slits 521 extending in the toe-heel direction are formed in the prepreg 52. With this configuration, the flexural rigidity mainly in the face-back direction can be decreased while reducing the influence on the flexural rigidity in the toe-heel direction.

Figure 25:
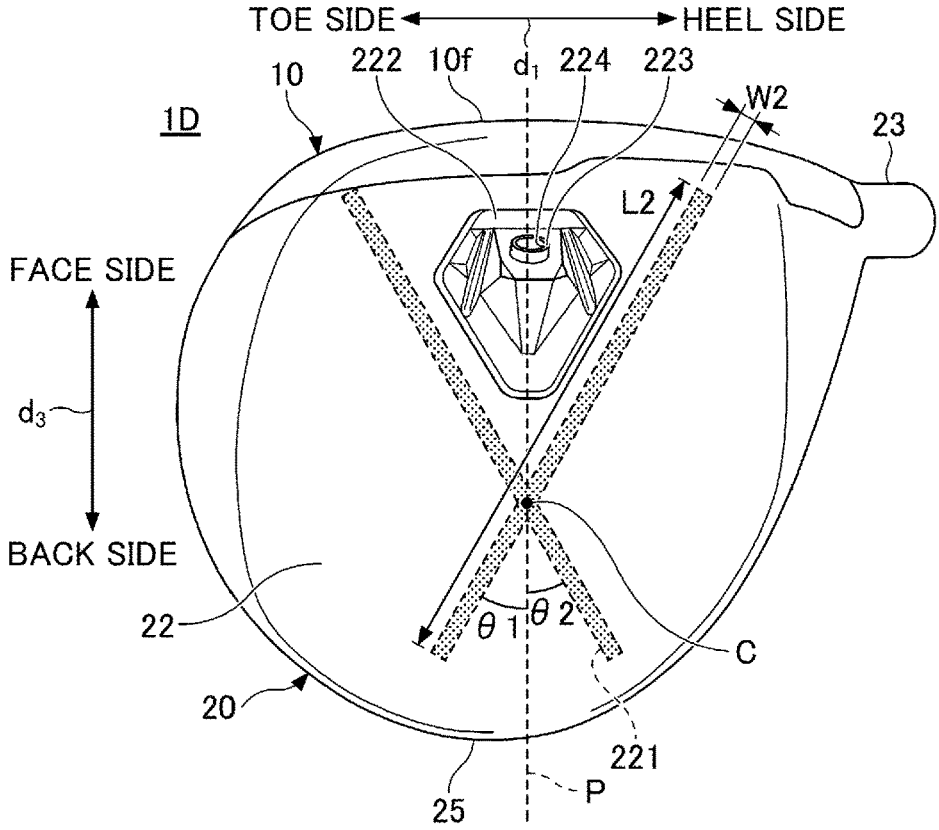
FIG. 25 is a bottom view of the golf club head 1D according to the first modification of the second embodiment.
Figure 26:
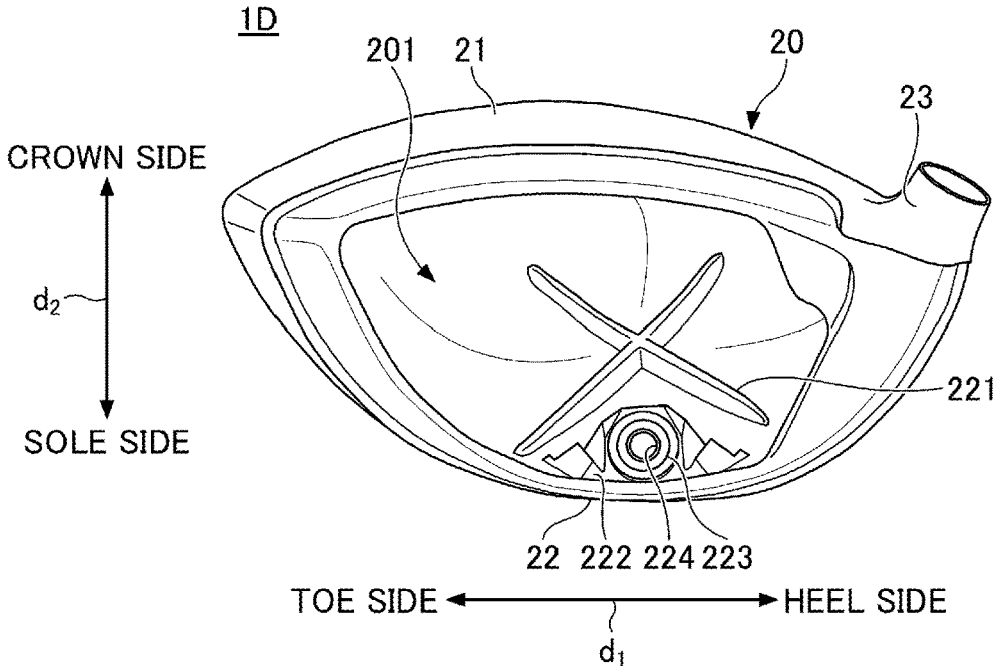
FIG. 26 a front view of a body of the golf club head 1D according to the first modification of the second embodiment.

FIG. 25 is a bottom view of the golf club head 1D according to the first modification of the second embodiment. FIG. 26 is a front view of the body of the golf club head 1D according to the first modification of the second embodiment. As illustrated in FIG. 25 and FIG. 26, the sole 22 includes two ribs 221. The two ribs 221 may be formed of a fiber-reinforced resin and arranged to intersect with each other when viewed in the crown-sole direction. The ribs 221 may be formed of the same fiber-reinforced resin as the sole 22. The ribs 221 serve as rigidity control portions that increase the flexural rigidity in the face-back direction. Carbon fibers of the fiber-reinforced resin constituting the sole 22 are preferably oriented in directions approximately the same as the extending directions of the ribs 221.

The two ribs 221 are projecting portions that are elongated to extend from the back surface side cf the face 10 toward the back end 25 and inclined with respect to a plane P. The plane P is perpendicular to a horizontal ground plane on which the golf club head 1D rests at a predetermined lie angle and a predetermined loft angle, and includes an axis that extends from the center of the face 10 in a direction normal to the face 10. Viewing in the crown-sole direction means viewing in a direction normal to the horizontal ground plane on which the golf club head 1D rests at the predetermined lie angle and the predetermined loft angle.

When viewed in the crown-sole direction, inclination angles θ1 and θ2 of the two ribs 221 with respect to the plane P may be, for example, greater than or equal to 15 degrees and less than or equal to 45 degrees, and are preferably greater than or equal to 25 degrees and less than or equal to 35 degrees.

When viewed in the crown-sole direction, an intersection C of the two ribs 221 is preferably positioned so as to overlap with the plane P. By positioning the two ribs 221 in this manner, the rigidity of a part of the sole 22 can be readily increased.

Each of the ribs 221 has a width W2, for example, greater than or equal to 0.5 mm and less than or equal to 3.0 mm and preferably greater than or equal to 1.0 mm and less than or equal to 2.0 mm. Each of the ribs 221 has a height greater than or equal to 0.5 mm and less than or equal to 10 mm and preferably greater than or equal to 2.0 mm and less than or equal to 6.0 mm. Each of the ribs 221 has a length L2, for example, greater than or equal to 30.0 mm and less than or equal to 120.0 mm and preferably greater than or equal to 60.0 mm and less than or equal to 80.0 mm.

In the examples of FIG. 25 and FIG. 26, two ribs 221 are provided; however, this is merely an example. One or more ribs 221 may be provided depending on the required rigidity. For example, a single rib 221 that extends in a straight line or a curved line in any direction may be provided. If a plurality of ribs 221 are provided, the plurality of ribs 221 do not necessarily intersect with each other. For example, two or more ribs 221 may be arranged in parallel approximately in the face-back direction, or may be arranged in a V shape that opens toward the face side. Alternatively, one or more ribs 221 that are approximately parallel to the face-back direction and one or more ribs 221 that are approximately perpendicular to the face-back direction may be arranged to intersect with each other.

In order to form such a slit 211 and a rib 221, the slit may be formed in a portion of prepregs and a portion of the prepregs may be formed in a rib shape before the prepregs are laminated when a golf club head is manufactured by the method described in the first embodiment.

As described above, in the golf club head 1D, at least the crown 21, the sole 22, and the hosel chamber 23 of the body 20 are formed by laminating layers of a fiber-reinforced resin. Accordingly, the rigidity of the crown 21 and the rigidity of the sole 22 can be readily adjusted in contrast to when the crown 21 and the sole 22 are formed of a metal such as titanium. The ball striking performance of the golf club head 1D is improved by controlling the rigidity of the crown 21 and the rigidity of the sole 22, which are formed of a fiber-reinforced resin. Specifically, while the slits 211 decrease the flexural rigidity in the face-back direction of the crown 21, the ribs 221 increase the flexural rigidity in the face-back direction of the sole 22. Accordingly, the crown 21 can readily deflect by the impact of a golf ball, and the launch angle of the golf ball can be increased.

For a golf club head in which the body 20 is formed of a metal such as titanium, there may be many limitations depending on the manufacturing method (casting or forging). Particularly, if the thickness of a predetermined portion is increased in order to partially increase the flexural rigidity, the weight of the predetermined portion would be increased. As a result, the degree of freedom in designing functions of the head would be reduced. Similarly, if the thickness of a predetermined portion is decreased in order to partially decrease the flexural rigidity, the structural strength of the head would be reduced. As a result, the head would be susceptible to damage from impact when hitting a ball. Therefore, it would not be easy to decrease the rigidity of a crown 21 and increase the rigidity of a sole 22 while reducing the influence on other elements. Thus, rigidity control would be limited to a narrow range.

In contrast, in the above-described manufacturing method in which a fiber-reinforced resin is used as the material of the body 20, prepregs including fibers having various elastic moduli may be used, prepregs having different ratios of fibers to a resin may be used, prepregs may be formed in various shapes, or prepregs may be combined with a different material (such as a metal wire, metal mesh, or a blowing agent). Accordingly, rigidity can be designed in a wider range, not achievable if the body 20 were formed of metal such as titanium. As a result, golf clubs with suitable characteristics can be provided to golfers with different swing types.

In the present embodiment, the slits 211 are adopted as rigidity control portions that decrease the flexural rigidity mainly in the face-back direction while reducing the influence on the flexural rigidity in the toe-heel direction, and the ribs 221 are adopted as rigidity control portions that increase the flexural rigidity in the face-back direction. However, the present invention is not limited thereto, and the slits 211 are not necessarily formed. For example, a low elasticity material may be provided or a prepreg sheet cut in a rectangular shape and having slit-like openings may be provided in a portion where the slits 211 are formed as illustrated in FIG. 22. Further, metal wires or metal mesh may be adopted instead of the ribs 221. Alternatively, the ribs 221 may be metal pieces, or may be metal pieces covered by a fiber-reinforced resin. Examples of low elasticity materials include resins, rubber, and fiber-reinforced resins.

In the present embodiment, the rigidity control portions that decrease the flexural rigidity mainly in the face-back direction while reducing the influence on the flexural rigidity in the toe-heel direction are provided in the crown 21, and the rigidity control portions that increase the flexural rigidity in the face-back direction are provided in the sole 22. However, the present invention is not limited thereto, and rigidity control portions that increase the flexural rigidity mainly in the face-back direction while reducing the influence on the flexural rigidity in the toe-heel direction may be provided in the crown 21, and rigidity control portions that decrease the flexural rigidity mainly in the face-back direction while reducing the influence on the flexural rigidity in the toe-heel direction may be provided in the sole 22. In this case, the effect for preventing a ball from being hit too high can be provided.

Second Modification of Second Embodiment

In a second modification of the second embodiment, a golf club head in which a metal hosel is attached to the hosel chamber 23 will be described. In the second modification of the second embodiment, descriptions of elements identical to those in the above-described embodiment may be omitted.

Figure 27:
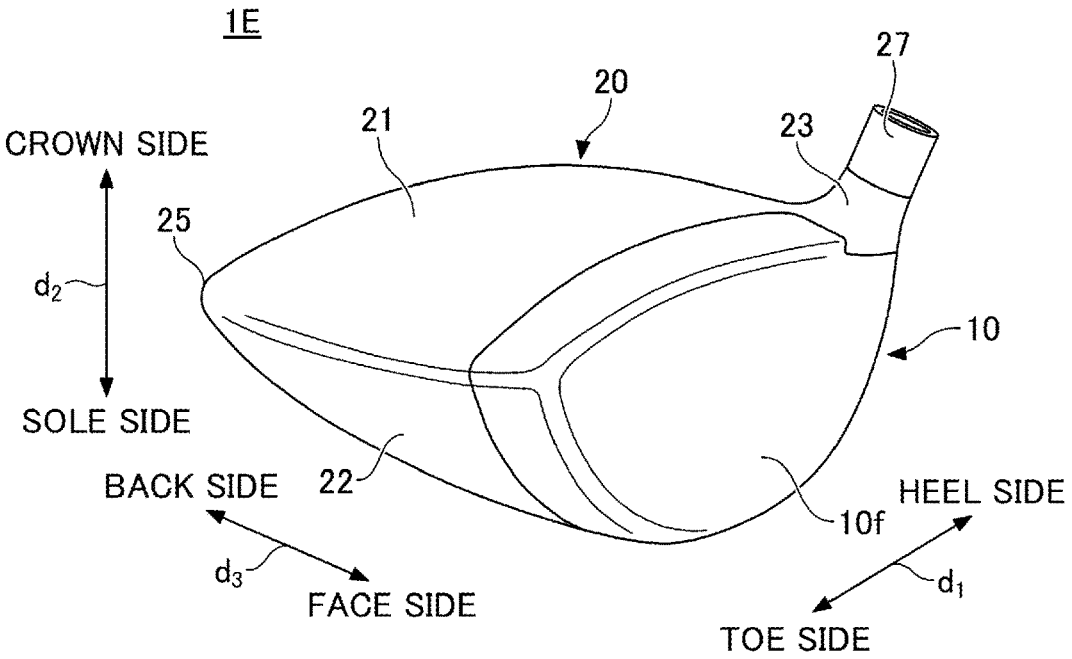
FIG. 27 is a perspective view of a golf club head 1E according to a second modification of the second embodiment.
Figure 28:
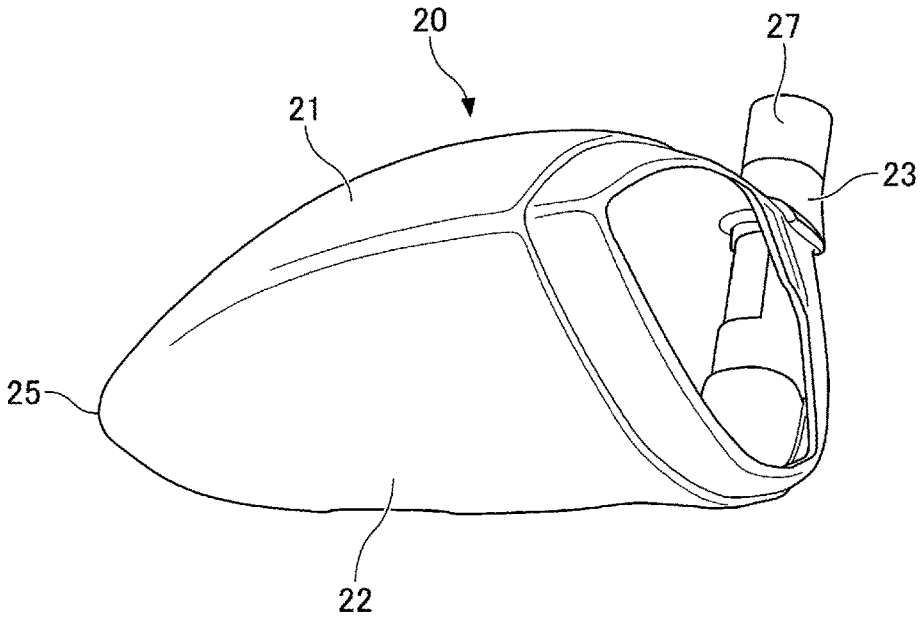
FIG. 28 is a perspective view of a body of the golf club head 1E according to the second modification of the second embodiment.
Figure 29:
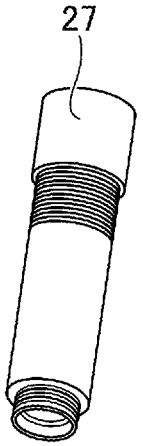
FIG. 29 is a perspective view of a metal hosel 27.

FIG. 27 is a perspective view of a golf club head 1E according to the second modification of the second embodiment. FIG. 28 is a perspective view of a body of the golf club head 1E according to the second modification of the second embodiment. FIG. 29 is a perspective view of a metal hosel 27.

As illustrated in FIG. 27 through FIG. 29, in the golf club head 1E, at least a crown 21, a sole 22, and a hosel chamber 23 of a body 20 are formed by laminating layers of a fiber-reinforced resin.

In the golf club head 1E, the hosel chamber 23 extends through the body 20 and to the sole 22. The hosel chamber 23 has a hollow cylindrical shape and houses the metal hosel 27. A large diameter portion on one end side of the metal hosel 27 is exposed from the hosel chamber 23. A portion of the hosel chamber 23 located within the body 20 is cut out to expose the side surface of the metal hosel 27.

The metal hosel 27 may be a member having a hollow cylindrical shape. For example, titanium, a titanium alloy, aluminum, an aluminum alloy, tungsten, a tungsten alloy, stainless steel, or the like may be used as the material of the metal hosel 27. The metal hosel 27 may be integrally formed with the fiber-reinforced resin included in the body 20.

In order to form the metal hosel 27 integrally with the fiber-reinforced resin included in the body 20, the metal hosel 27 may be placed within a blank of the body 20 when the blank of the body 20 is formed by attaching a plurality of prepregs to a mold assembly such that the plurality of prepregs are laminated. Specifically, the metal hosel 27 may be bonded to the prepregs, or the metal hosel 27 may be covered by the prepregs.

In this manner, in the golf club head 1E, at least the crown 21, the sole 22, and the hosel chamber 23 of the body 20 are formed by laminating layers of a fiber-reinforced resin. Therefore, the metal hosel 27 can be readily embedded into the body 20. By embedding the metal hosel 27, the strength of the metal hosel 27 can be enhanced as compared to when a hosel formed of a resin is used.

Figure 30:
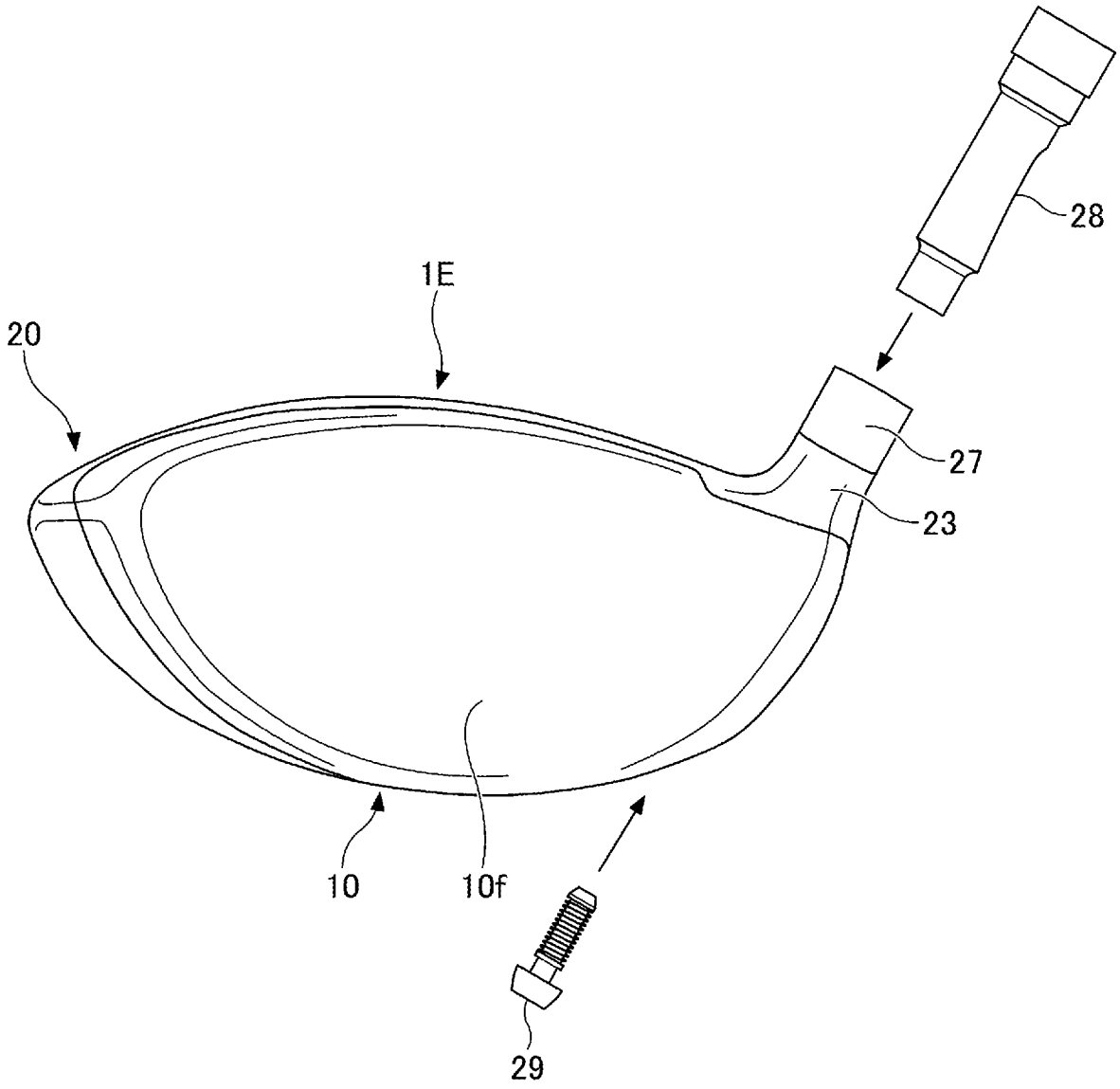
FIG. 30 is a diagram illustrating a variable shaft adjustability mechanism.

The golf club head 1E may have a variable shaft adjustability mechanism. The variable shaft adjustability mechanism may include the metal hosel 27, a shaft case 28, and an attachment screw 29 as illustrated in FIG. 30. Specifically, the shaft case 28 is housed within the metal hosel 27 and is removably attached to the metal hosel 27 by the attachment screw 29 from the sole 22 side. For example, the shaft case 28 may be affixed to a shaft with an adhesive.

One or both of a hole of the metal hosel 27 and a hole of the shaft case 28 may be eccentric. Therefore, attaching the shaft case 28 to the metal hosel 27 by causing the shaft case 28 to rotate in a circumferential direction allows the positional relationship between the golf club head 1B and the shaft (for example, a lie angle, a face angle, and the like) to be adjusted.

Third Embodiment

In a third embodiment of the present disclosure, golf club heads each including a body having a different configuration will be described. In the third embodiment, descriptions of elements identical to those in the above-described embodiments may be omitted.

Figure 31:
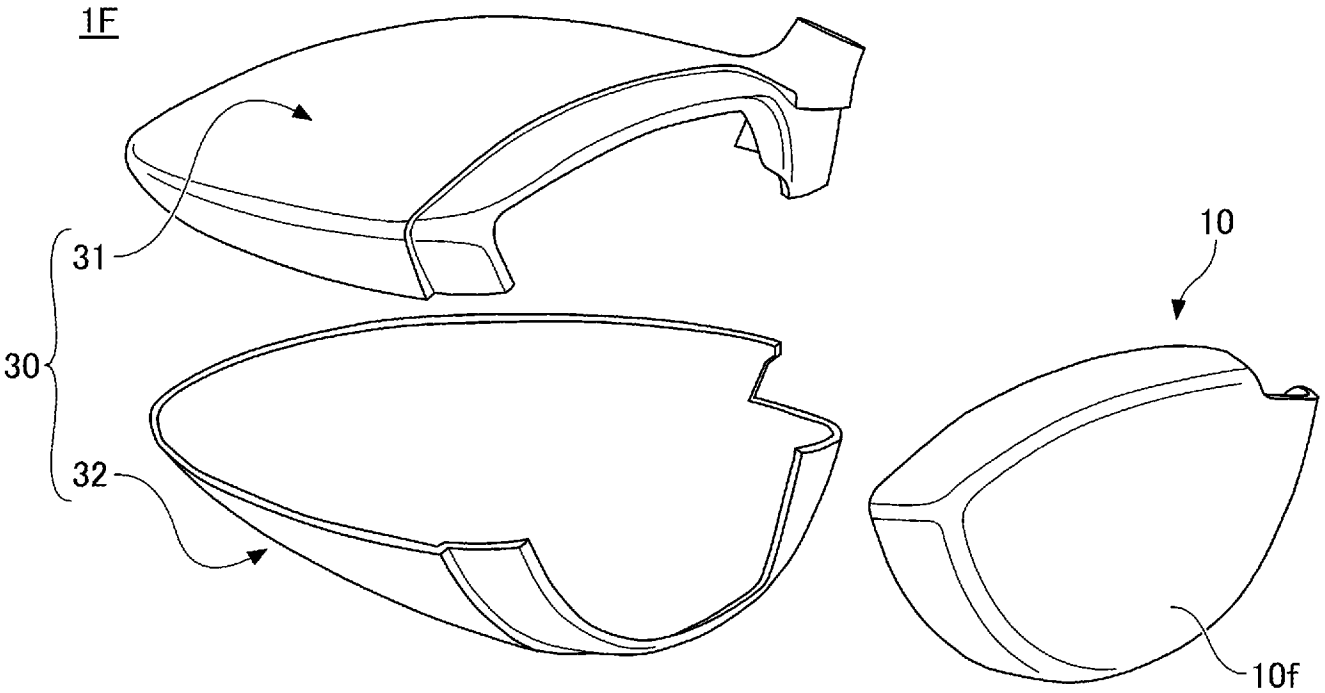
FIG. 31 is an exploded perspective view of a golf club head 1F according to a third embodiment.

FIG. 31 is an exploded perspective view of a golf club head 1F according to the third embodiment. As illustrated in FIG. 31, the golf club head 1F has a hollow structure in which the face 10 is integrated with a body 30.

The body 30 includes a first member 31 located on the crown side and a second member 32 located on the sole side. The first member 31 and the second member 32 are combined to form the body 30, and the body 30 and the face 10 are further combined to form the golf club head 1F.

For example, the golf club head 1F may be manufactured by a method as described below. First, a mold assembly, constituted by an upper mold and a lower mold that can be assembled and disassembled, is prepared. A plurality of layers of prepregs, formed of a fiber-reinforced resin, are prepared, and the prepregs are attached to the upper mold so as to be laminated. In this manner, the first member 31 is formed. Next, a plurality of layers of prepregs formed of a fiber-reinforced resin are prepared, and the prepregs are attached to the lower mold so as to be laminated. In this manner, the second member 32 is formed.

Next, the upper mold and the lower mold are assembled such that the first member 31 is coupled to the second member 32. In this manner, a blank of the body 30 of the golf club head 1F is formed.

Next, the mold assembly including the blank of the body 30 is placed into a bag. The bag is placed in an openable sealed container, and heat is applied by the heating mechanism while a vacuum is created by the pneumatic mechanism. In this manner, the prepregs formed of the fiber-reinforced resin, which constitute the blank of the body 30, are cured by a cross-linking reaction. After the heating, the body 30 is bonded to the preformed face 10 to form a semi-finished golf club head. The semi-finished golf club head is deburred and subjected to surface finishing to obtain the golf club head 1F.

Figure 32:
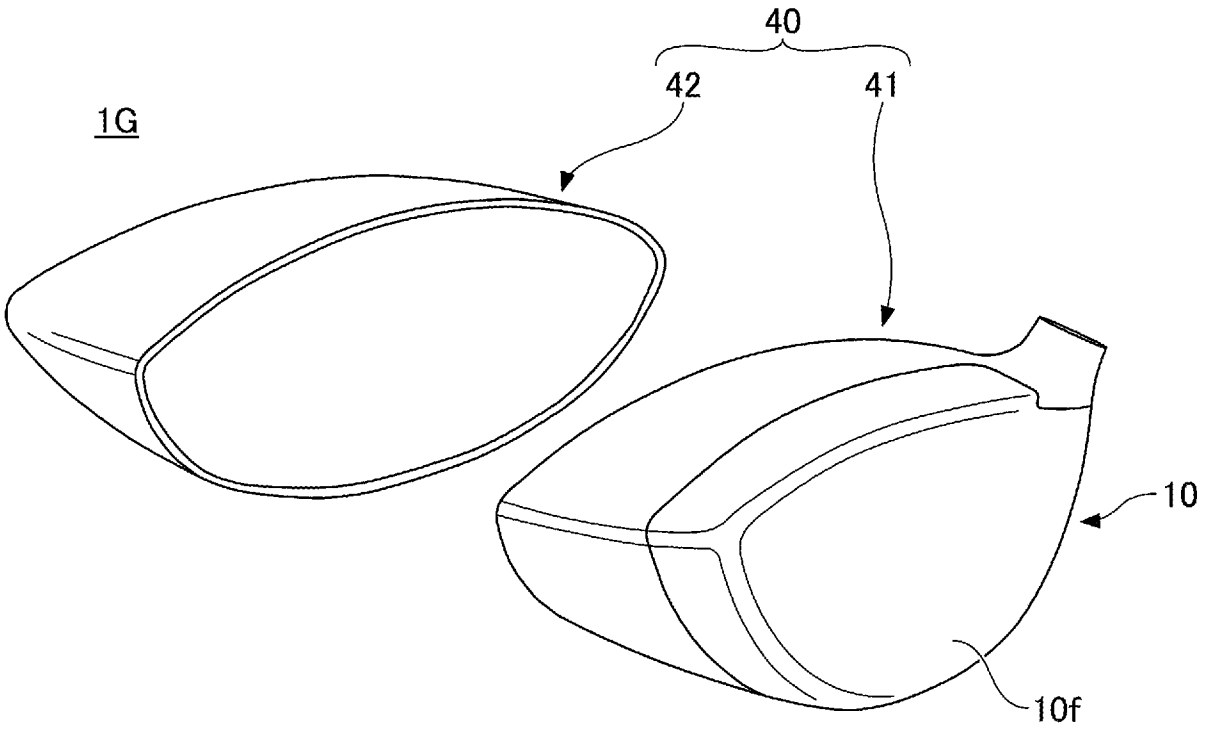
FIG. 32 is an exploded perspective view of a golf club head 1G according to the third embodiment.

FIG. 32 is an exploded perspective view of a golf club head 1G according to the third embodiment. As illustrated in FIG. 32, the golf club head 1G has a hollow structure in which the face 10 is integrated with a body 40.

The body 40 includes a first member 41 located on the face side and a second member 42 located on the back side. The first member 41 and the second member 42 are combined to form the body 40, and the body 40 and the face 10 are further combined to form the golf club head 1G.

For example, the golf club head 1G may be manufactured by a method as described below. First, a mold assembly, constituted by a front mold and a back mold that can be assembled and disassembled, is prepared. A plurality of layers of prepregs, formed of a fiber-reinforced resin, are prepared, and the prepregs are attached to the front mold so as to be laminated. In this manner, the first member 41 is formed. Next, a plurality of layers of prepregs formed of a fiber-reinforced resin are prepared, and the prepregs are attached to the back mold so as to be laminated. In this manner, the second member 42 is formed.

Next, the front mold and the back mold are assembled such that the first member 41 and the second member 42 are coupled together. In this manner, a blank of the body 40 of the golf club head 1G is formed.

Next, the mold assembly including the blank of the body 40 is placed into a bag. The bag is placed in an openable sealed container, and heat is applied by the heating mechanism while a vacuum is created by the pneumatic mechanism. In this manner, the prepregs formed of the fiber-reinforced resin, which constitute the blank of the body 40, are cured by a cross-linking reaction. After the heating, the body 40 is bonded to the preformed face 10 to form a semi-finished golf club head. The semi-finished golf club head is deburred and subjected to surface finishing to obtain the golf club head 1G.

As described above, an integrally formed body may be used as described in the golf club heads 1 through 1D, or a composite body may be used as described in the golf club heads 1F and 1G.

Although the embodiments of the present invention have been described in detail above, the present invention is not limited to the particulars of the above-described embodiments. Variations and modifications may be applied to the above-described embodiments without departing from the scope of the present invention.

What is claimed is:

1. A golf club head having a hollow structure, the golf club head comprising:

a face; and a body including at least a crown, a sole, and a hosel chamber, the crown, the sole, and the hosel chamber including laminated layers of a fiber-reinforced resin, wherein the crown includes at least one first rigidity control portion that partially extends in a toe-heel direction, wherein the sole includes at least one second rigidity control portion that extends from a back surface side of the face toward a back end of the body, and wherein one of the first rigidity control portion and the second rigidity control portion decreases flexural rigidity in a face-back direction, and the other of the first rigidity control portion and the second rigidity control portion increases flexural rigidity in the face-back direction, wherein the first rigidity control portion is provided as a thin slit that decreases the flexural rigidity in the face-back direction, and the second rigidity control portion is a rib that increases the flexural rigidity in the face-back direction, wherein the first rigidity control portion is provided as a thin slit that decreases the flexural rigidity in the face-back direction, and the second rigidity control portion is a rib that increases the flexural rigidity in the face-back direction, and wherein the crown includes a fiber-reinforced resin in which reinforcing fibers are oriented in one direction, the one direction is substantially parallel to the face-back direction, and the slit is formed in the fiber-reinforced resin of the crown.

2. The golf club head according to claim 1, wherein the second rigidity control portion is provided as two ribs formed of a fiber-reinforced resin and arranged to intersect with each other.

3. The golf club head according to claim 2, wherein, when viewed in a crown-sole direction, an intersection of the two ribs is positioned so as to overlap with a first plane, the first plane being perpendicular to a horizontal ground plane, on which the golf club head rests at a predetermined lie angle and a predetermined loft angle, and including an axis that extends from a center of the face in a direction normal to the face.

4. The golf club head according to claim 2, wherein the sole includes a recessed portion that is recessed from an outer surface side toward an inner surface side of the sole, and wherein, when viewed in a crown-sole direction, the two ribs are positioned so as not to overlap with the recessed portion, and are positioned in a vicinity of the recessed portion.

5. The golf club head according to claim 1, wherein the first rigidity control portion increases the flexural rigidity, and the second rigidity control portion decreases the flexural rigidity.

6. The golf club head according to claim 1, wherein the crown includes laminated layers comprising an uppermost layer of a prepreg, a lowermost layer of the prepreg and at least one middle layer of the prepreg sandwiched between the uppermost layer and the lowermost layer.

7. The golf club head according to claim 1, wherein slits are provided to the middle layer of the laminated layers.

8. The golf club head according to claim 1, wherein the slits are formed so as to extend in a direction that intersects a direction of the reinforcing fibers of the fiber-reinforced resin of the crown.

9. A golf club head having a hollow structure, the golf club head comprising:

a face; and a body including a crown, and a sole, at least the sole including laminated layers of a fiber-reinforced resin;

wherein the sole includes a recessed portion that is recessed from an outer surface side toward an inner surface side of the sole, wherein the recessed portion includes a connector made of metal, wherein a rod is attached to the connector such that the rod extends from the recessed portion to a back surface of the face and contacts the back surface of the face, wherein the crown includes a thin slit that decreases flexural rigidity in a face-back direction, wherein the crown includes a fiber-reinforced resin in which reinforcing fibers are oriented in one direction, wherein the one direction is substantially parallel to the face-back direction, and wherein the slit is formed in the fiber-reinforced resin of the crown.

10. The golf club head according to claim 9, wherein the connector is integrally formed with the fiber-reinforced resin of the sole.

11. The golf club head according to claim 9, wherein the connector includes a female thread, the rod includes a male thread, and the rod is screwed into the connector.

12. The golf club head according to claim 9, wherein the face is made of metal, and the face is formed separately from the connector.

13. The golf club head according to claim 9, wherein the rod includes a metallic member and a non-metallic member, and the metallic member indirectly contacts the face via the non-metallic member.

14. The golf club head according to claim 9, wherein the body includes a hosel chamber, the hosel chamber including laminated layers of a fiber-reinforced resin, the hosel chamber houses a metal hosel, and the metal hosel is integrally formed with a fiber-reinforced resin included in the body.

15. The golf club head according to claim 9, wherein the connector is integrally formed with a fiber-reinforced resin included in the body.

16. The golf club head according to claim 9, wherein the crown includes laminated layers of a fiber-reinforced resin and is integrally formed with the sole.

17. The golf club head according to claim 9, wherein the sole includes a rib that increases flexural rigidity in a face-back direction.

* * * * *